US010533363B2

(12) United States Patent
Hyde

(10) Patent No.: US 10,533,363 B2
(45) Date of Patent: Jan. 14, 2020

(54) STAND-UP GUN SAFE

(71) Applicant: RPH Engineering, LLC, Lehi, UT (US)

(72) Inventor: Ryan P. Hyde, Lehi, UT (US)

( * ) Notice: Subject to any disclaimer, the term of this patent is extended or adjusted under 35 U.S.C. 154(b) by 0 days.

(21) Appl. No.: 15/821,293

(22) Filed: Nov. 22, 2017

(65) Prior Publication Data

US 2018/0163456 A1 Jun. 14, 2018

Related U.S. Application Data

(63) Continuation-in-part of application No. 15/702,743, filed on Sep. 12, 2017, now abandoned, which is a (Continued)

(51) Int. Cl.

| | |
|---|---|
| ***E05G 1/026*** | (2006.01) |
| ***E05G 1/10*** | (2006.01) |
| ***E05G 1/04*** | (2006.01) |
| ***E05B 47/00*** | (2006.01) |
| ***E05B 65/00*** | (2006.01) |
| ***E05B 45/06*** | (2006.01) |
| ***E05F 1/10*** | (2006.01) |
| ***E05D 3/02*** | (2006.01) |
| ***E05C 1/00*** | (2006.01) |
| ***E05C 1/08*** | (2006.01) |
| ***E05C 7/04*** | (2006.01) |

(52) U.S. Cl.

CPC ..... *E05G 1/026* (2013.01); *E05B 47/0001* (2013.01); *E05B 65/0075* (2013.01); *E05G 1/04* (2013.01); *E05G 1/10* (2013.01); *E05B 45/06* (2013.01); *E05B 2047/0088* (2013.01); *E05C 1/002* (2013.01); *E05C 1/08* (2013.01); *E05C 7/04* (2013.01); *E05D 3/02* (2013.01); *E05F 1/10* (2013.01); *E05G 2700/02* (2013.01); *E05G 2700/04* (2013.01)

(58) Field of Classification Search

CPC .. E05G 1/026; E05G 1/10; E05G 1/04; E05B 47/00; E05B 65/00; B65D 25/28

USPC ..... 340/5.2, 10.1–10.5; 135/15.1, 17, 34.2; 206/317; 190/118

See application file for complete search history.

(56) References Cited

U.S. PATENT DOCUMENTS 3,543,890 A * 12/1970 Criswell ..... A47B 3/10 190/12 R 5,027,967 A * 7/1991 Tellas ..... A45C 11/38 190/118

(Continued)

*Primary Examiner* — Nam V Nguyen

(74) *Attorney, Agent, or Firm* — Strong & Hanni, P.C.; Joseph Shapiro

(57) ABSTRACT

A stand-up gun safe comprises a substantially vertical, but moderately tilted, spine that supports one or more hinges, which in turn support two shell components that rotate relative to the spine and swivel relative to each other. In a closed configuration, the respective edges of the two shell components abut each other, creating a secure seam. In an open configuration, the two shell components are separated from each other as they swivel and rotate away from each other on the hinges secured to the spine. A locking mechanism keeps the two shell components in a closed state. Because the spine is tilted, and the two shells are located on the top of the spine, when the lock is released gravity forces the two shells apart from each other, thereby resulting in a gravity-powered opening.

18 Claims, 21 Drawing Sheets

Related U.S. Application Data continuation-in-part of application No. 14/106,684, filed on Dec. 13, 2013, now Pat. No. 9,797,680.

(56) References Cited

U.S. PATENT DOCUMENTS

| | | | | | |
|---|---|---|---|---|---|
| 5,671,830 | A * | 9/1997 | Wood | A45C 13/02 | 150/101 |
| 5,852,883 | A * | 12/1998 | Ziglar | D06F 95/002 | 34/621 |
| 5,989,092 | A * | 11/1999 | McGowan | G09F 19/08 | 40/411 |
| 6,405,861 | B1 * | 6/2002 | Siler | F41C 33/06 | 206/1.5 |
| 6,591,453 | B2 * | 7/2003 | Jenks | E05D 11/1007 | 16/329 |
| 6,918,474 | B2 * | 7/2005 | Nykoluk | A45C 5/14 | 16/113.1 |
| 7,500,704 | B2 * | 3/2009 | Herrera | B60R 7/06 | 296/37.12 |
| 8,439,374 | B1 * | 5/2013 | Elden | B62B 1/12 | 280/47.26 |
| 9,055,794 | B1 * | 6/2015 | Gorouvein | A45B 25/00 | |
| 9,797,680 | B2 * | 10/2017 | Hyde | F41C 33/06 | |
| 2002/0179181 | A1 * | 12/2002 | Murphy | B25H 1/04 | 144/286.5 |
| 2008/0111330 | A1 * | 5/2008 | Lurie | A63C 11/026 | 280/35 |

* cited by examiner

STAND-UP GUN SAFE

BACKGROUND OF THE INVENTION

Designing a gun safe requires compromise between three at least three competing considerations: security, accessibility, and aesthetics.

Maximizing security at the expense of accessibility and aesthetics will likely result in a gun safe that is large, ugly, and difficult or time-consuming to open. Although such a design may make it difficult for unauthorized parties (e.g., children and intruders) to access the contents of the gun safe, such a gun safe may be too large to place in a useful location, too ugly to place in a useful location, and/or may be too difficult to open when access is necessary (e.g., to oppose a burglar).

Maximizing accessibility at the expense of security and aesthetics will likely result in a gun safe that is so easy to open that it is not secure. Although the contents of such a gun safe may be easy to access when necessary (e.g., to oppose a burglar) the same accessibility may undermine security by making it too easy for unauthorized parties (e.g., children and intruders) to access the contents of the gun safe.

Maximizing aesthetics at the expense of security and accessibility will likely result in a gun safe that is not strong enough to be secure. Although such a gun safe may be conspicuously placed in a living room or other environment without contrasting or detracting from the surrounding décor, the gun safe may be too small, or may not be sufficiently strong tough to prevent unauthorized access (e.g., to children or intruders) and may compromise accessibility to authorized parties (e.g., the owner).

What is needed is a gun safe that minimizes or decreases the compromises between security, accessibility, and aesthetics.

BRIEF SUMMARY OF THE INVENTION

An improved secure storage apparatus is disclosed. In one embodiment, the disclosed apparatus may be a gun safe. Other embodiments may employ the same or similar principles and/or innovations for other applications of a secure storage apparatus or unit. The guns safe or secure storage apparatus disclosed herein includes improved features for security, accessibility, aesthetics, and usability.

In one embodiment, a gun safe may comprise one or more hinges mounted or secured to a spine. The hinges may support a left shell and a right that, when in a closed configuration, form a closed storage compartment.

The respective sides of the left shell and right shell that are opposite the sides that are secured to the hinges may include a locking mechanism, so that when the two shells swing on the hinges toward or into a closed configuration, the locking mechanism engages, thereby securing the gun safe in a closed position such that the contents of the gun safe are not accessible.

The hinges may be designed to be secured to the spine such that the bolts or other securement mechanism by which the hinges are secured to the spine are accessible only from the interior of the gun safe, and are therefore not accessible when the gun safe is in a closed configuration. The hinges and shells may further be designed so that the bolts or securement mechanisms by which the shells are secured to the hinges are accessible only from the interior of the gun safe, and are therefore not accessible when the gun safe is in a closed position.

In general, in the closed configuration, the edges of the two shells abut each other and form a tight seam. In one embodiment, the edges of the two shells may form a lap joint to increase security of the gun safe by making it more difficult to pry apart the two shells or similarly compromise the gun safe.

The spine may be oriented substantially vertically, but will be slightly angled so that the gun safe has the appearance of leaning or being tilted backwards, with the shells disposed on top of the spine. Because the spine is tilted in this manner, with the shells disposed on the top of the spine, when the lock is released the force of gravity results in the two shells separating and "falling" into an open configuration.

In one embodiment, a spring-loaded pin may be included in one of the shells, exerting a force to separate the two shells, such that when the lock is released, the spring loaded pin provides assistance, in addition to gravity, to push apart the two shells toward the open configuration.

The gun safe may include a signal permeable layer to allow for passage of electromagnetic signals to the gun safe's control system. Such electromagnetic signals may include, e.g., Wi-Fi, Bluetooth, NFC, RFID, and other signals and communication technologies known in the art. The signal permeable layer may be made of a material that is protective and as secure as possible but which still allows for signals to pass from the exterior of the gun safe to the gun safe's control system, which is housed within the shells comprising the gun safe.

The locking mechanism may comprise a shaft with a substantially conical head that may be inserted into a receiver, wherein the conically shaped head pushes apart spring-loaded semi-circle lock collars, which contract after the conical head has passed, thereby preventing withdrawal of the conical head. The locking mechanism may include a servo motor that, when actuated, turns the semi-circle lock collars such that they are not restricting withdrawal of the shaft and conical head. In this manner the gun safe may use the servo motor to unlock and allow opening of the gun safe.

The gun safe may include a sensor system for detecting environmental or other conditions relating to the gun safe. Sensors may include, but are not limited to, wireless signal sensors, biometric sensors, motion sensors, and other sensors known in the art. In one embodiment, the gun safe may include one or more gyroscopes, accelerometers, fingerprint sensors, thermal emission biometric sensors, and/or wireless signal sensors. The collected sensor signals and/or data may be passed to the control system, which may process the signals to identify credentials for opening, unlocking, or modifying the gun safe, or may determine that one or more events have occurred that should be logged or reported. For example, the sensor system may collect Wi-Fi, Bluetooth, RFID, NFC, or other signals that comprise credential information. The sensor system may transmit this signal data to the control system, which may determine whether the provided credentials are sufficient for opening or unlocking the gun safe.

Motion or movement data from sensors, e.g., from one or more gyroscopes, accelerometers, or GPS modules, may result in the necessity of communicating an alert or notification to a user or computer system regarding an event, e.g., unauthorized opening, movement, rotation, shaking, dropping, or striking. The gun safe may transmit an alert or notification to a phone, computer, server, router, or other device over Wi-Fi, Blutooth, or other communication technologies known in the art.

The gun safe may also include power management features, e.g., intermittently turning on Wi-Fi or other wireless communication technologies only intermittently instead of continuously, or enabling fingerprint sensor only when a button is pressed.

In one embodiment, the gun safe may include a sound device, e.g., a buzzer or alarm, to provide notifications or to provide a loud or otherwise conspicuous alert or sound when an unauthorized even occurs with the gun safe, e.g., movement or striking or other attempts to compromise.

The gun safe may also include one or more speakers, e.g., Bluetooth speakers, to add to the functionality of the gun safe.

In one embodiment, the gun safe may be configured to implement geofencing, whereby the gun safe detects movement, e.g., through accelerometers or a GPS module, provides an alert, notification, alarm, or other event if the gun safe is moved or relocated out of an allowable area.

The gun safe may be powered by a traditional electrical system, and/or USB port for power, and/or a rechargeable battery.

DETAILED DESCRIPTION OF THE INVENTION

Priority

Figure 1:
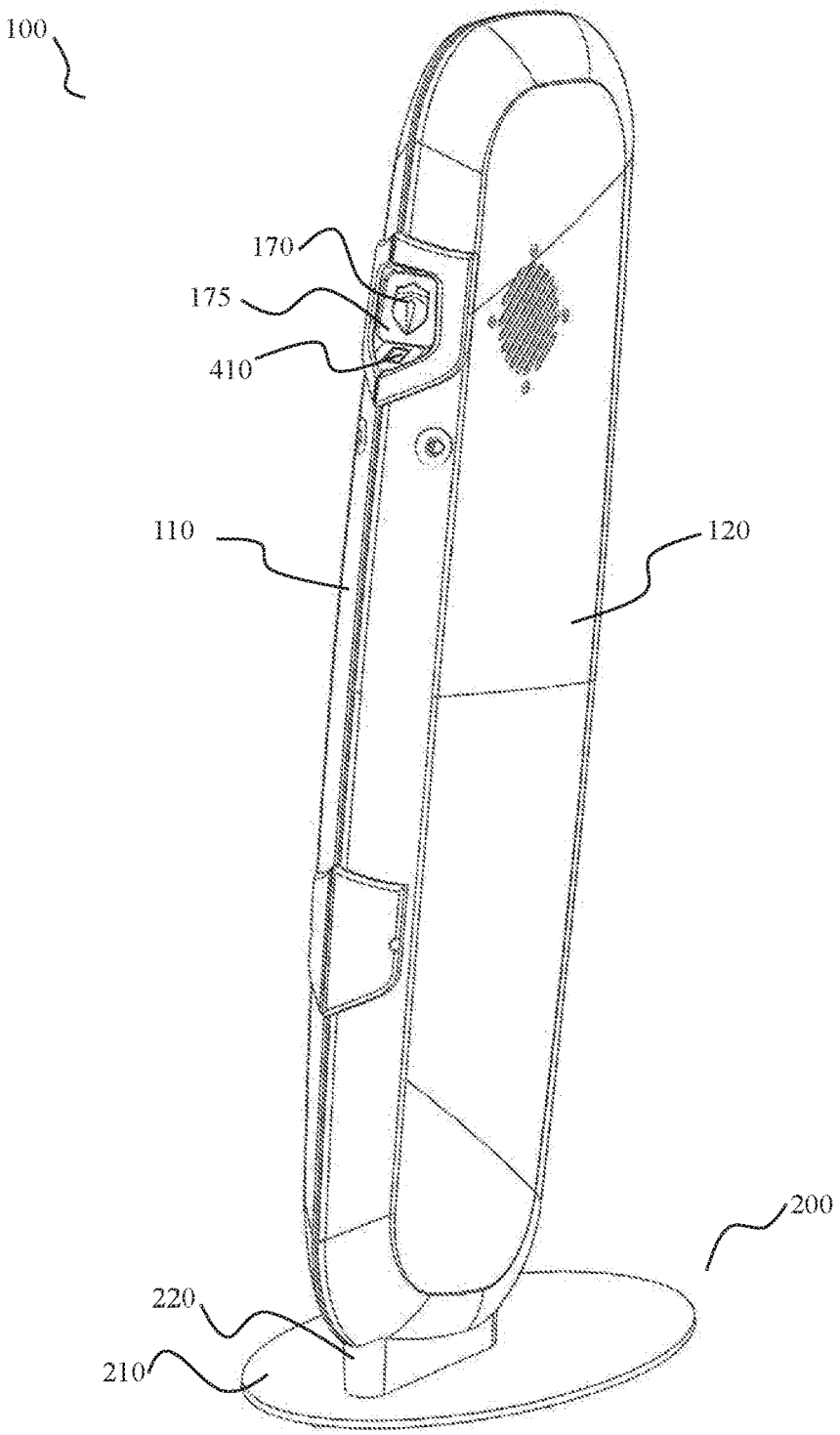
FIG. 1 shows a front angle view of an exemplary gun safe in a closed configuration.

This application is a continuation-in-part of U.S. patent application Ser. No. 15/702,743, titled Stand-Up Safe for Guns and Secure Storage, and filed Sep. 12, 2017, which is abandoned, which is in turn a continuation-in-part of U.S. patent application Ser. No. 14/106,684, titled Secure Storage Systems and Methods, and filed on Dec. 13, 2013, which has issued as U.S. Pat. No. 9,797,680. This application claims priority to and the benefit of Patent Application Nos. 14/106,684 and 15/702,743, and incorporates by reference the contents thereof in their entirety.

General

Although the description herein references and focuses on a gun safe, the disclosure herein is applicable to any secure storage compartment, and may be used for many items other than guns or firearms.

Several reference numbers are used herein for ease of referencing the drawings in the associated text. The following table provides a listing of the reference numbers along with a short description of the associated items from the drawings:

| Reference Number | Description |
|---|---|
| 100 | gun safe |
| 102 | front of gun safe |
| 104 | rear of gun safe |
| 110 | left shell |
| 120 | right shell |
| 130 | support tube |
| 150 | upper hinge |
| 151a | first rotating cap component |
| 151b | second rotating cap component |
| 152 | middle-stationary component |
| 153a | left shell adapter |
| 153b | interior left shell adapter plate |
| 154a | right shell adapter |
| 154b | interior right shell adapter plate |
| 155 | upper hinge pin |
| 156a-e | left shell adapter screws |
| 157a-e | left shell adapter screws |
| 158a-e | left shell adapter screw holes |
| 159a-e | right shell adapter screw holes |
| 161a | first screw hole in upper hinge 150 |
| 161b | second screw hole in upper |

-continued

| Reference Number | Description |
|---|---|
| | hinge 150 |
| 162a | first upper hinge securement bolt |
| 162b | second upper hinge securement bolt |
| 165 | lower hinge |
| 170 | signal permeable layer |
| 171 | first aperture |
| 172 | second aperture |
| 173 | third aperture |
| 175 | signal permeable layer assembly |
| 176 | adapter |
| 176a | exterior adapter |
| 176b | interior adapter |
| 180 | sensor support structure |
| 200 | base |
| 210 | base plate |
| 220 | base boot |
| 222 | base boot cavity |
| 225 | base boot cover |
| 226 | shaft hole in base boot cover |
| 230 | charging/power interface |
| 240 | rechargeable battery |
| 252 | control power wire |
| 254 | accessory power wire |
| 255 | motor control wire |
| 270 | left shell Bluetooth speaker |
| 272 | right shell Bluetooth speaker |
| 320 | upper lock assembly |
| 321 | screw for securing upper lock assembly to shell 120 |
| 322 | upper spring-loaded pin |
| 323 | strike location for upper spring-loaded pin |
| 324a | first threaded receiver in shaft for securing upper hinge |
| 324b | second threaded receiver in shaft for securing upper hinge |
| 325 | shaft |
| 326 | conical head |
| 327 | guide collar |
| 328 | lock assembly face |
| 329 | aperture |
| 330 | upper lock receiver assembly |
| 331 | face of upper lock receiver assembly |
| 332 | aperture in upper lock receiver assembly |
| 333 | screw for securing upper lock receiver assembly |
| 334 | rotating motor in upper lock receiver assembly |
| 335a | clasping semi-circle |
| 335b | clasping semi-circle |
| 336a | clasping semi-circle spring |
| 336b | clasping semi-circle spring |
| 340 | lower lock assembly |
| 342 | lower spring-loaded pin |
| 343 | strike location for lower spring-loaded pin |
| 350 | lower lock receiver assembly |
| 400 | sensor system |
| 410 | fingerprint reader |
| 412 | fingerprint sensor |
| 420 | radio frequency receiver |
| 430 | GPS receiver |
| 440 | accelerometer |
| 500 | control system |
| 510 | fingerprint sensor circuit |

-continued

| Reference Number | Description |
|---|---|
| | board |
| 520 | radio frequency receiver circuit board |
| 530 | GPS receiver circuit board |
| 540 | pressure switch |
| 550 | wireless transmitter |
| 560 | sound device |
| 570 | switch |
| 610 | geofencing perimeter |
| 615 | approved geographic zone |
| 617 | unapproved geographic zone |
| 702 | gun support |
| 704 | gun support adjustment slot |
| 706 | gun support set screw |
| 800 | speaker |
| 1300 | geofencing method |
| 1310 | step in geofencing flowchart |
| 1320 | step in geofencing flowchart |
| 1330 | step in geofencing flowchart |
| 1340 | step in geofencing flowchart |
| 1350 | step in geofencing flowchart |
| 1360 | step in geofencing flowchart |
| 1370 | step in geofencing flowchart |
| 1380 | step in geofencing flowchart |
| 1390 | step in geofencing flowchart |
| 1398 | step in geofencing flowchart |

An improved gun safe is disclosed with features for improved security, accessibility, aesthetics, and usability. Although the disclosed device is generally referred to herein as a "gun safe," it may be used in any application for securely storing one or more items.

Gun safe 100 may be designed to securely store one or more articles such as handguns, shotguns, rifles, or other articles. Gun safe 100 may store one or more guns or other articles securely and may do so such that only authorized user(s) may open gun safe 100 and access its contents.

Basic Components

Gun safe 100 may have many shapes. FIGS. 1-6 illustrate an exemplary shape for gun safe 100. It should be appreciated that the shape may be modified or adjusted for guns of different size; different numbers of guns; location where the gun safe will be placed; or for many other reasons, without substantively or materially departing from the disclosure herein.

In one embodiment, as shown in FIGS. 1-7, gun safe 100 is in part comprised of shells 110 and 120. Shells 110 and 120 may be made from aluminum, aluminum alloy, another metal or metal composite, or any other material known in the art that may be durable and secure. Such materials may provide a favorable balance of strength, impact resistance, and weight. In other embodiments, shells 110 and 120 may be made of steel, titanium, alloys thereof, ceramics, composite materials, and/or combinations thereof.

In general, the durability and security of the material for shells 110 and 120 may increase as the thickness of material increases. The weight of gun safe 100 may also increase as the thickness of the material for shells 110 and 120 increases. In one embodiment, shell 110 may be monolithic and/or shell 210 may be monolithic. In general, a monolithic shell may have improved security over a non-monolithic shell because of the absence of seams, which may be, in some designs, a vulnerability through which a gun safe may be compromised, e.g., by using a pry bar or other prying apparatus. If either of shells 110 and 120 is not monolithic, the panels or components comprising 110 and/or shell 120 may be secured to each other in any number of ways known in the art. In general, shells 110 and 120 may be more secure if the component panels are secured to each other using a securement mechanism, e.g., one or more screws, that are accessible only from the inside of gun safe 100.

In one embodiment, shells 110 and 120 may be made from aluminum or an aluminum composite and may be approximately 0.125 inches thick. Gun safe 100 may be shaped as shown in FIGS. 1-7 and may be approximately 3.0 tall, and 8.0 inches wide in a closed configuration as described herein.

Shells 110 and 120 may be made by casting or pressing or by any other process known in the art. A person of ordinary skill will appreciate that materials will have varying properties depending on how fabricated.

As shown in FIGS. 1-7, gun safe 100 may have a closed configuration and an open configuration. In the closed configuration, the rims of shells 110 and 120 abut each other to prevent access to the interior space.

Figure 2:
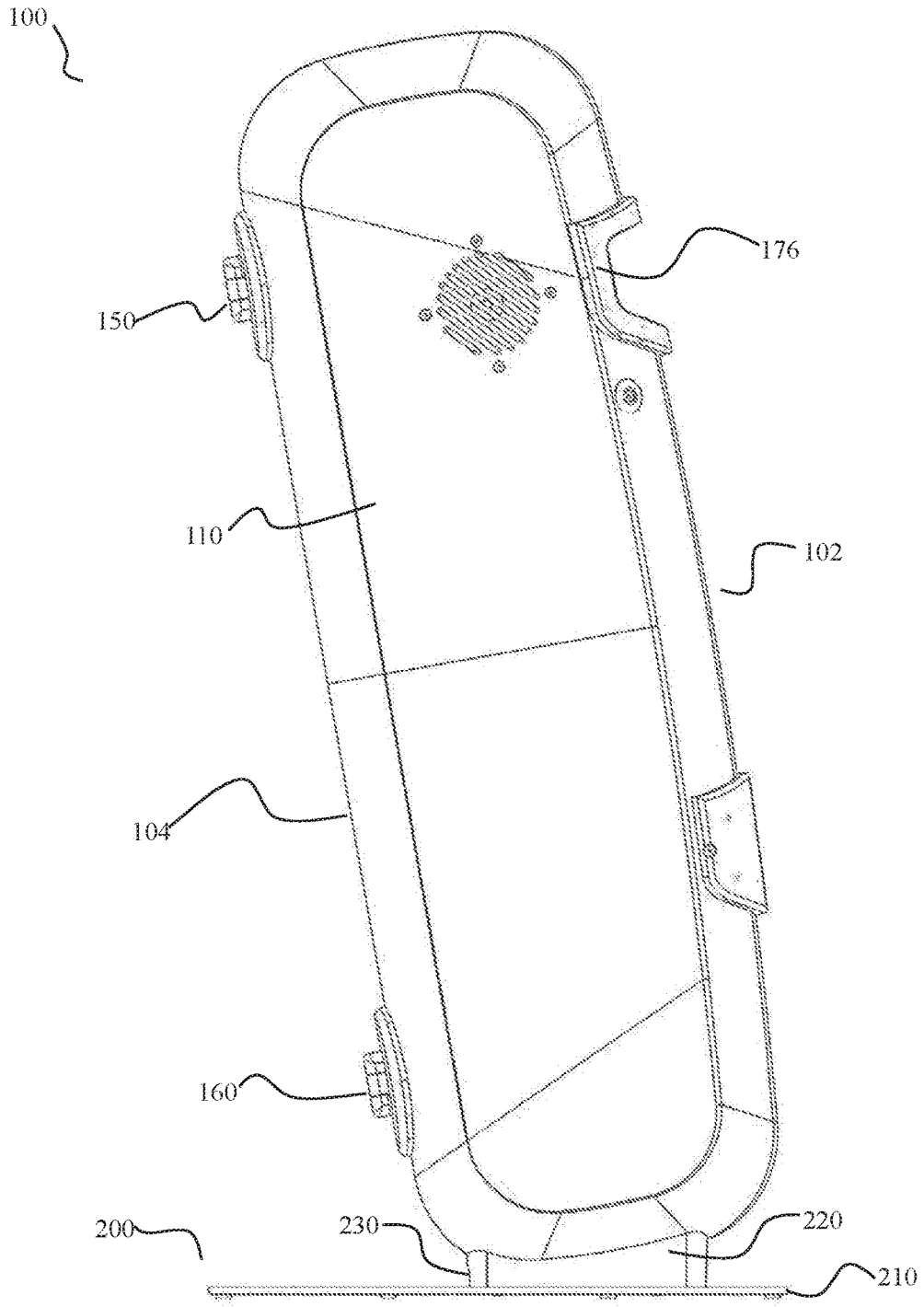
FIG. 2 shows a side profile view of an exemplary gun safe in a closed configuration.
Figure 3:
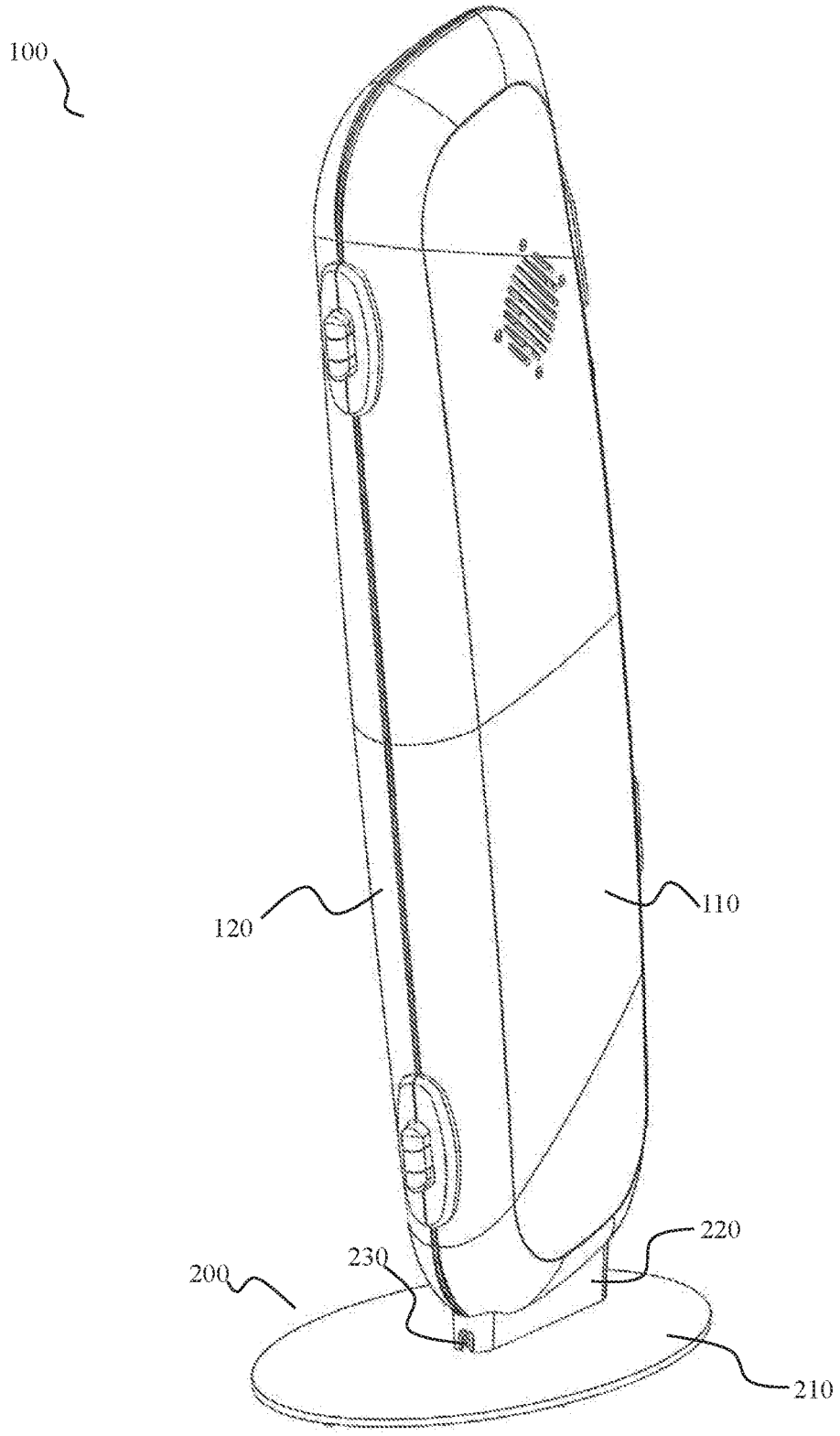
FIG. 3 shows a rear angle view of an exemplary gun safe in a closed configuration.
Figure 4:
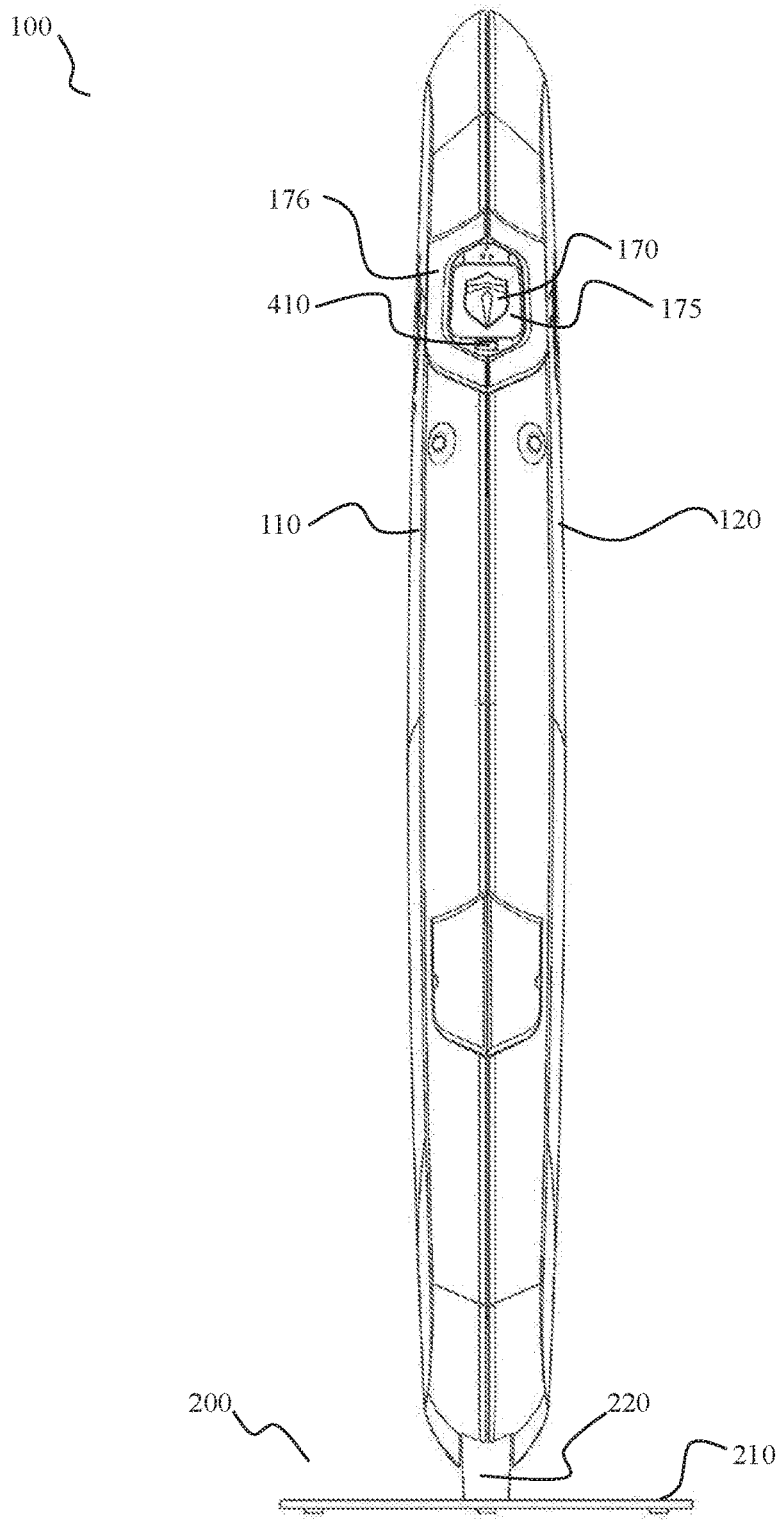
FIG. 4 shows a front view of an exemplary gun safe in a closed configuration.
Figure 5:
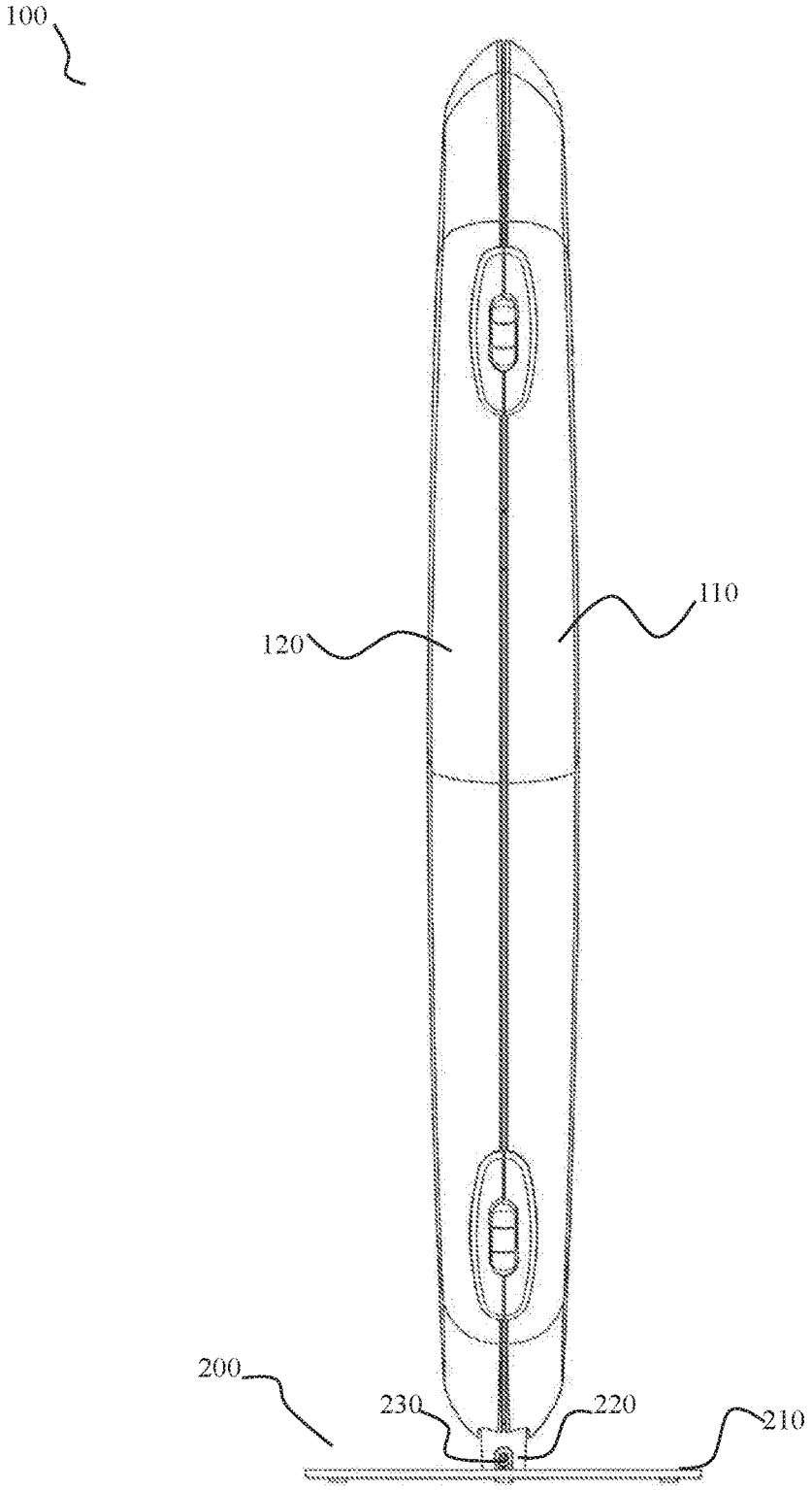
FIG. 5 shows a rear view of an exemplary gun safe in a closed configuration.
Figure 6:
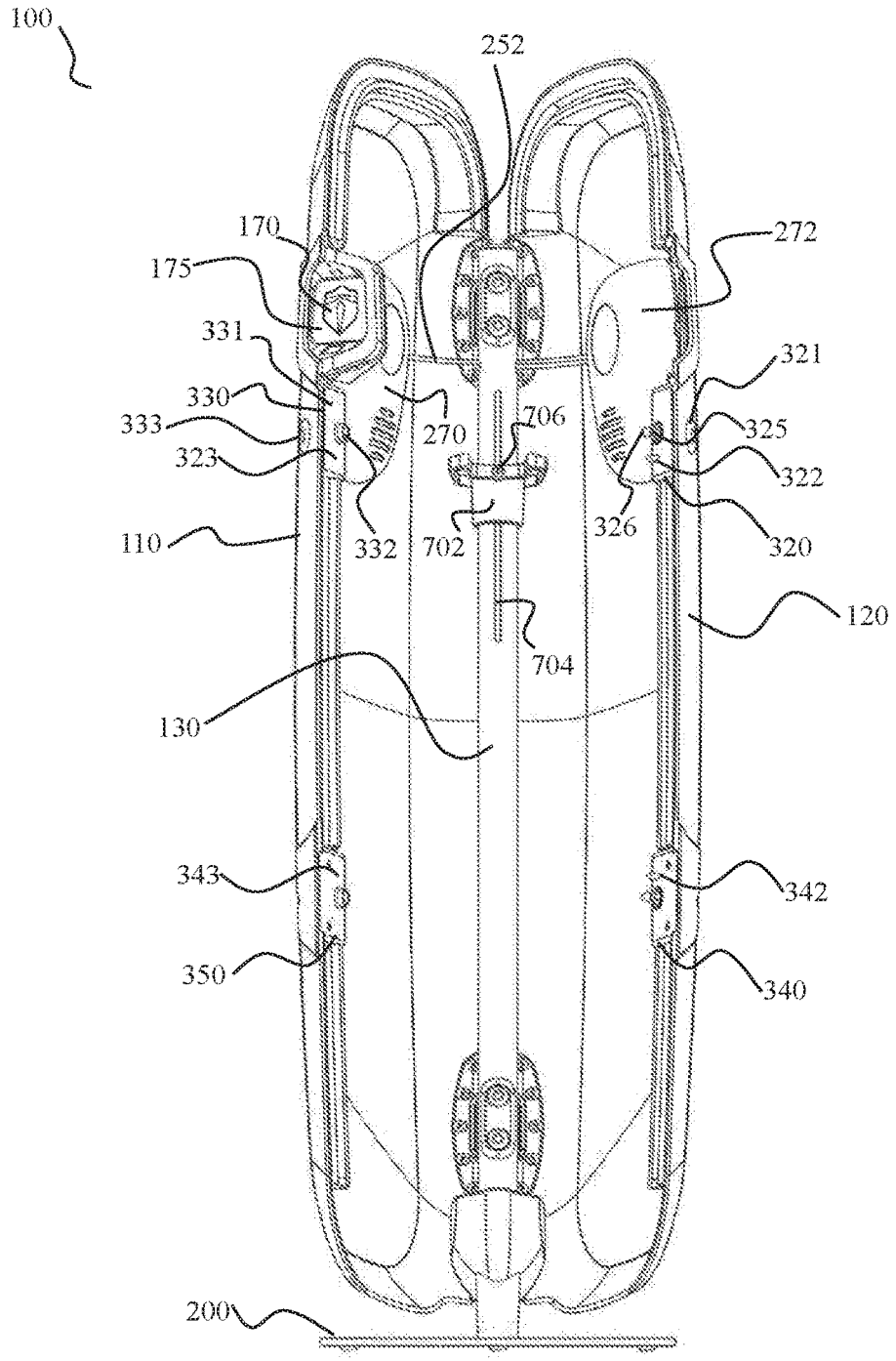
FIG. 6 shows a front view of an exemplary gun safe in an open configuration.
Figure 7:
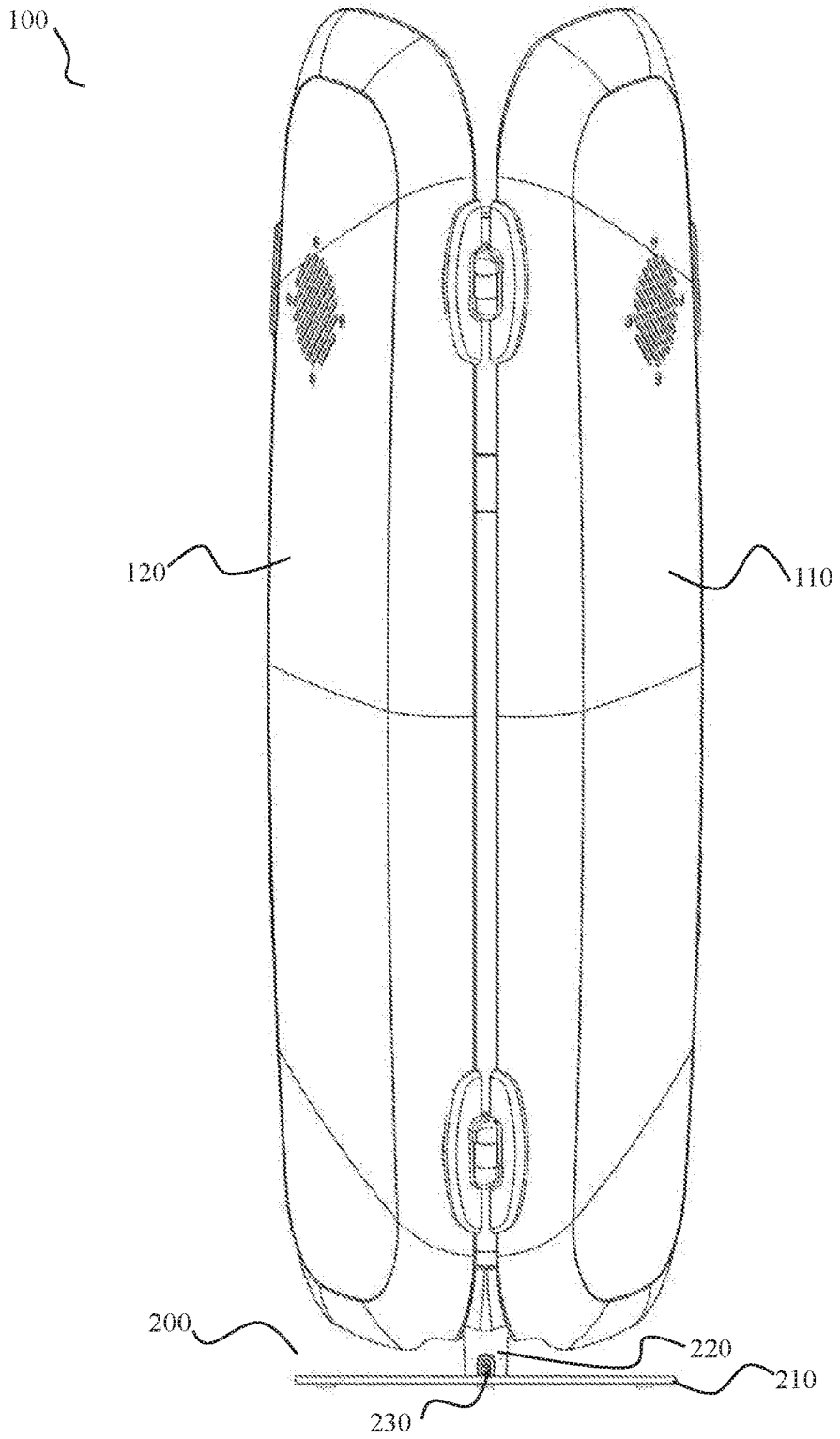
FIG. 7 shows a rear view of an exemplary gun safe in an open configuration.

FIGS. 1-7 show various perspectives and configurations of gun safe 100. FIG. 1 shows a front angle view of gun safe 100 in the closed configuration. FIG. 2 shows a side view of safe 100 in the closed configuration. FIG. 3 shows a rear angle view of gun safe 100 in the closed configuration. FIG. 4 shows a front view of gun safe 100 in the closed configuration. FIG. 5 shows a rear view of gun safe 100 in the closed configuration. FIG. 6 shows a front view of gun safe 100 in the open configuration. FIG. 7 shows a rear view of gun safe 100 in the open configuration.

In one embodiment, shells 110 and 120 may include complementary lap joints around some or all of their edges. A lap joint may increase the difficulty of inserting a pry bar or similar tool to gain unauthorized access to gun safe 100 when in a closed and locked configuration.

Shells 110 and 120 may be mechanically secured to each other by hinges 150 and 165. Shells 110 and 120 may, in some embodiments, be secured by only one hinge, or by more than two hinges.

Gun safe 100 may include base, or stand, 200. Base 200 may be made out of metal (e.g., aluminum, steel), a metal alloy, plastic, or any other material known in the art. Different components of base 200 may be made of different materials. A person of ordinary skill will appreciate that many materials are available, and that the selection of material may depend on one or more factors, including but not limited to cost, weight, durability, rigidity, security, or other factors. In one embodiment, base 200 may be made out of steel or a steel alloy and may comprise base plate 210 and base boot 220.

Figure 10:
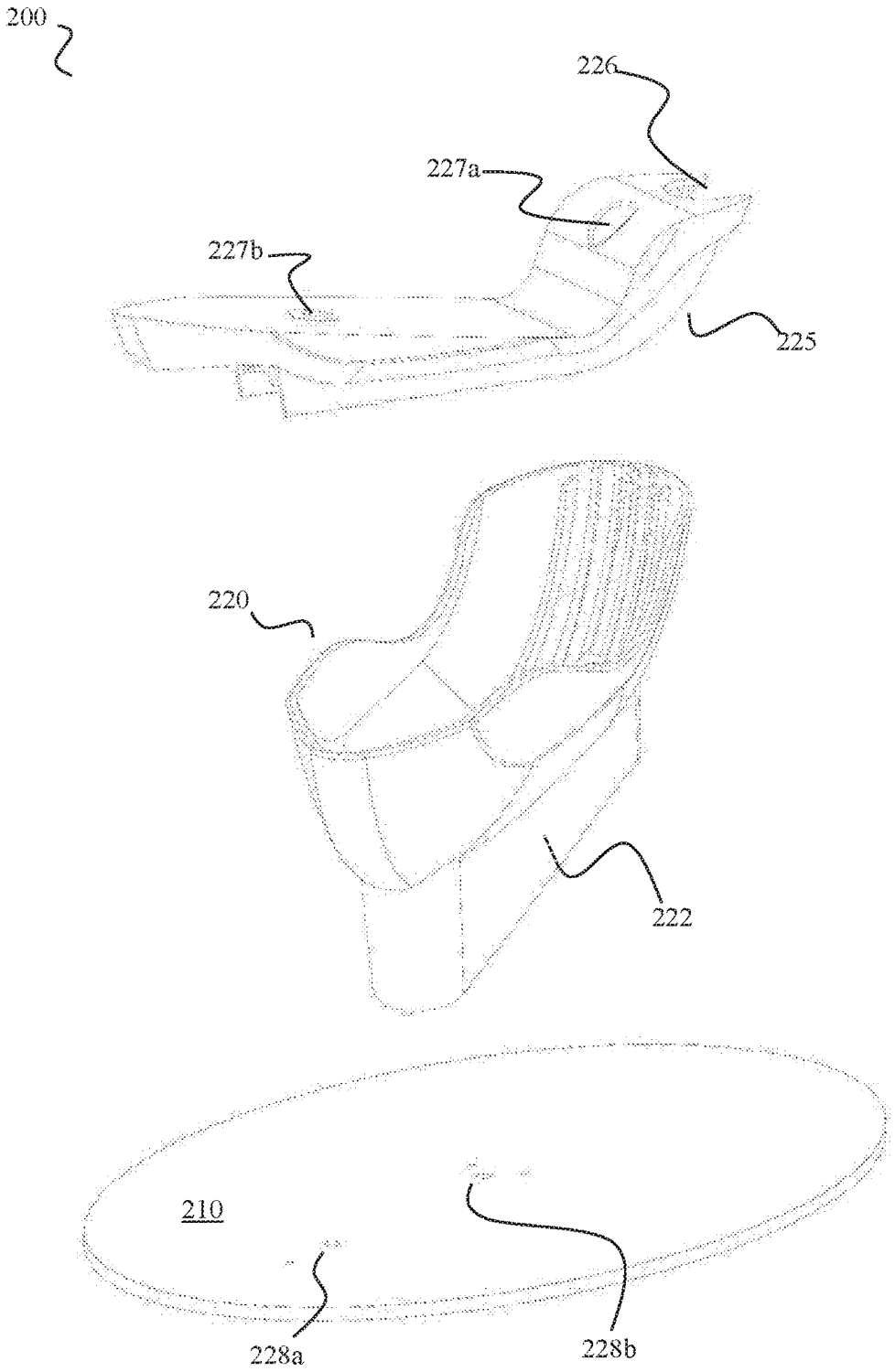
FIG. 10 shows an exploded view of a base for an exemplary gun safe.
Figure 12A:
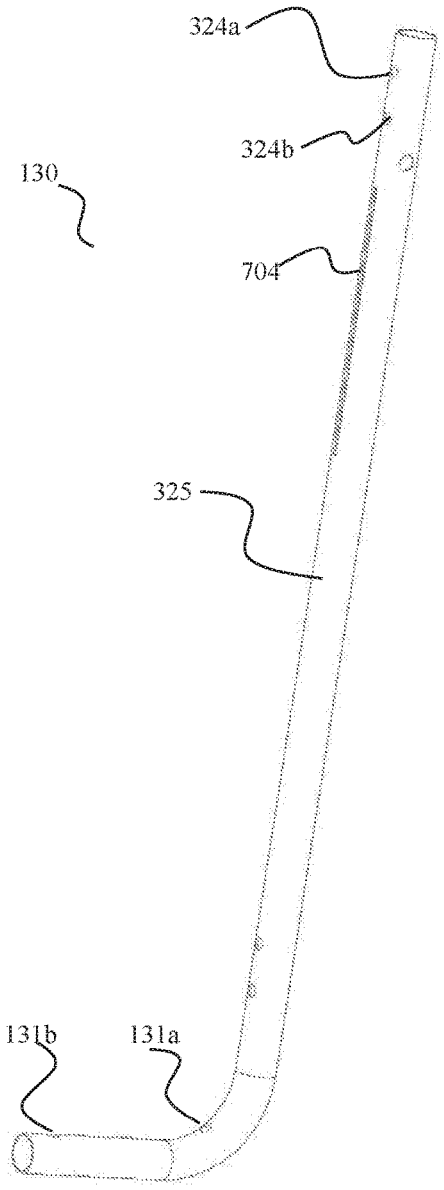
FIG. 12*a* shows a profile view of an exemplary spine.
Figure 12B:
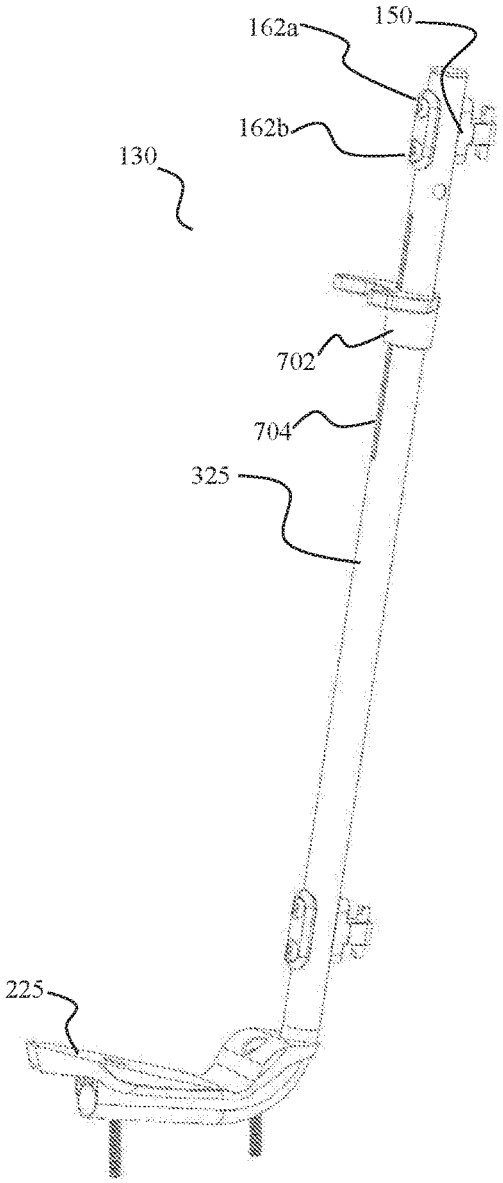
FIG. 12*b* shows a profile view of an exemplary spine with several components secured to the spine.

FIG. 10 shows an exploded view of base 200, including base plate 210, base boot 220, and base boot cover 225. L-shaped support tube 130, shown in FIGS. 12*a* and 12*b*, may be inserted into shaft hole 226 in base boot cover 225, and may rest in the bed of base boot 220, as shown in FIG. 12*b*. Base boot cover 225, support tube 130, and base boot 220 may be secured to base plate 210 by inserting bolts through holes 227*a* and 227*b* in base boot cover 225, through corresponding holes 131*a* and 131*b* in support tube 130, through corresponding holes in base boot 220, and into threaded receivers 228*a* and 228*b* in base plate 210, as shown in FIGS. 10 and 12*b*.

In one embodiment, base plate 210 may include holes that may be used to secure gun safe 100 to a surface.

Signal Permeable Layer

Because shells 110 and 120 may be formed of materials, such as metals, that may block, in whole or in part, wireless signals, gun safe 100 may include a signal permeable layer 170.

Signal permeable layer 170 may be made of materials that allow the passage of wireless signals. Many such materials are known in the art. Signal permeable layer 170 may act as a protective cover for one or more sensors, wireless receivers and/or transmitters, and similar electronics. Signal permeable layer 170 may be secured to shells 110 and 120.

Hinges

Shells 110 and 120 may be mechanically coupled together via one or more hinges or joints 150 and 165 that may permit shells 110 and 120 to move relative to each other and to move, in general, between a closed configuration and an open configuration.

FIGS. 14-17 show different angles of upper hinge 150 in the closed and open configurations. Separate detailed drawings of lower hinge 165 are not provided because, in the embodiment depicted, lower hinge 165 is identical to, or substantively identical to, upper hinge 150. Upper hinge 150 and lower hinge 165 may be made of aluminum, aluminum alloy, another metal or metal composite, a plastic, or any material sufficient strong, durable, and rigid for use as a secure hinge in a gun safe.

Figure 14A:
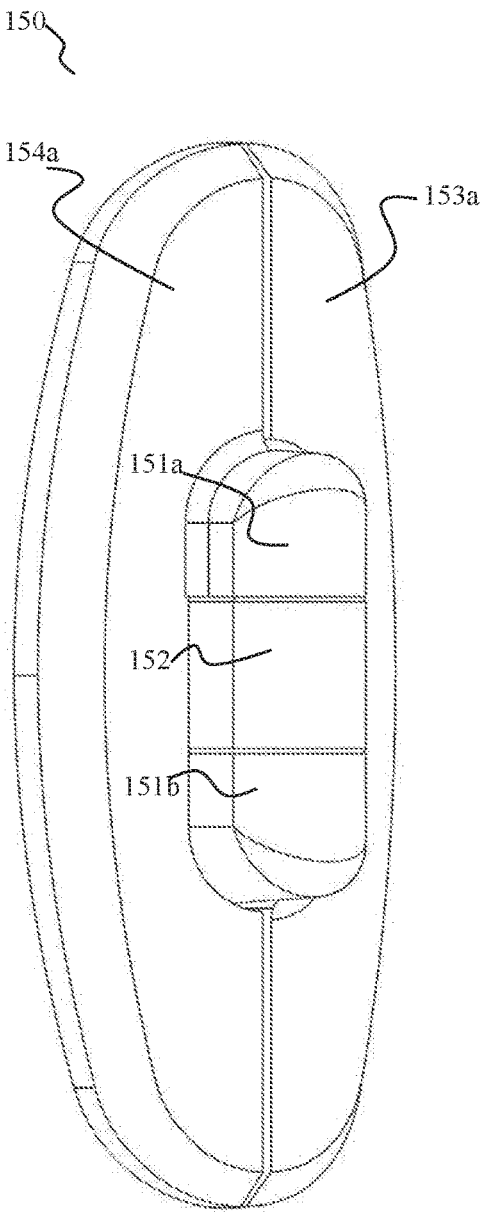
FIGS. 14*a* and 14*b* show a right-angle-exterior view and a left-angle-exterior view, respectively, of an exemplary hinge in a closed configuration.
Figure 14B:
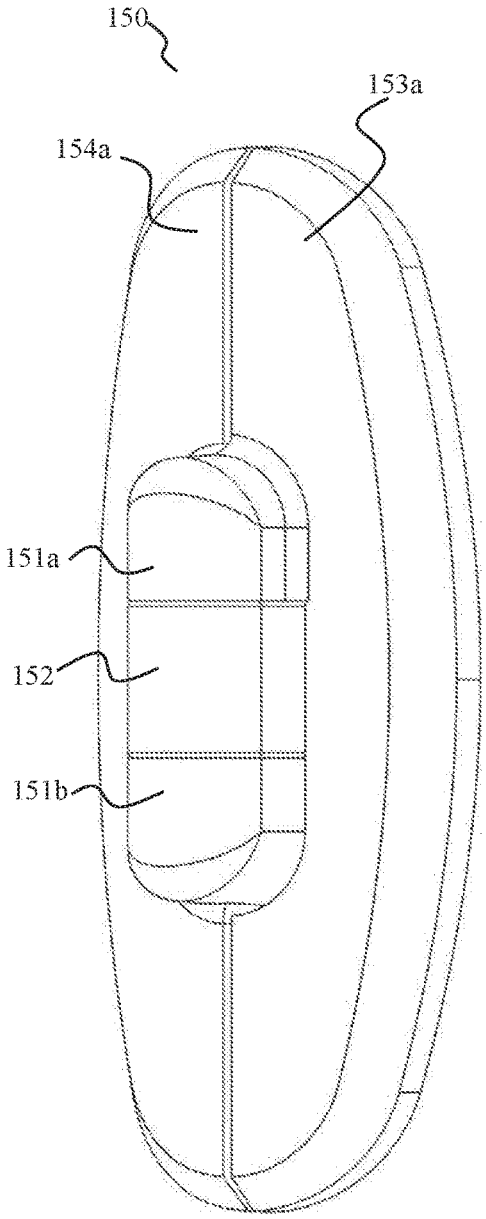
Figure 15:
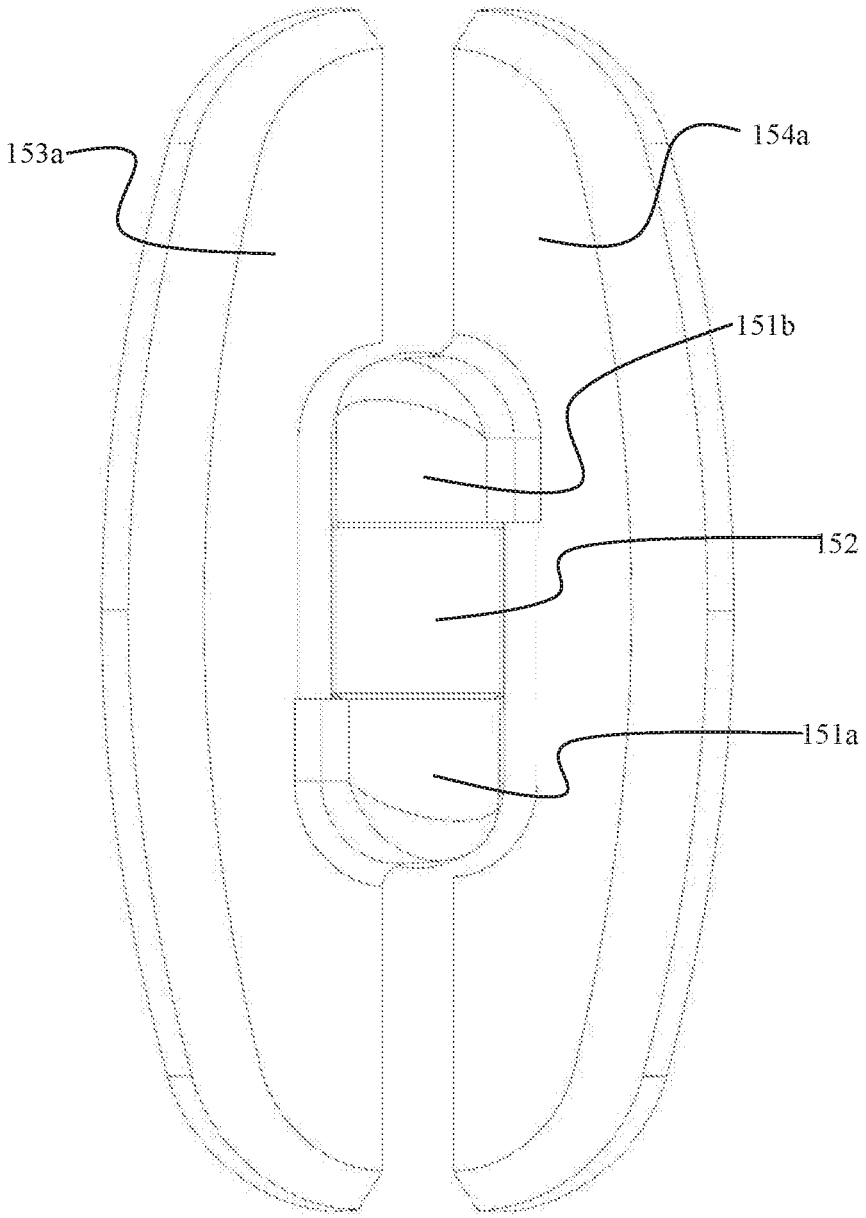
FIG. 15 shows an exterior view of an exemplary hinge in a closed configuration.

As shown in FIGS. 14 and 15, hinge 150 may be capped and/or otherwise sealed by first capped rotating component 151*a* and second capped rotating component 151*b*. Because hinge 150 is capped and sealed from the exterior, it may be disassembled only from the interior of gun safe 100, when gun safe 100 is in an open and unlocked configuration.

FIGS. 14*a* and 14*b* are close-up angle views of the exterior of upper hinge 150 when gun safe 100 is in a closed configuration. FIG. 14*a* shows upper hinge 150 from a rear-right perspective. FIG. 14*b* shows upper hinge 150 from a rear-left perspective.

FIG. 15 shows an exterior view of upper hinge 150 from the rear when gun safe 100 is in an open configuration.

Figure 16A:
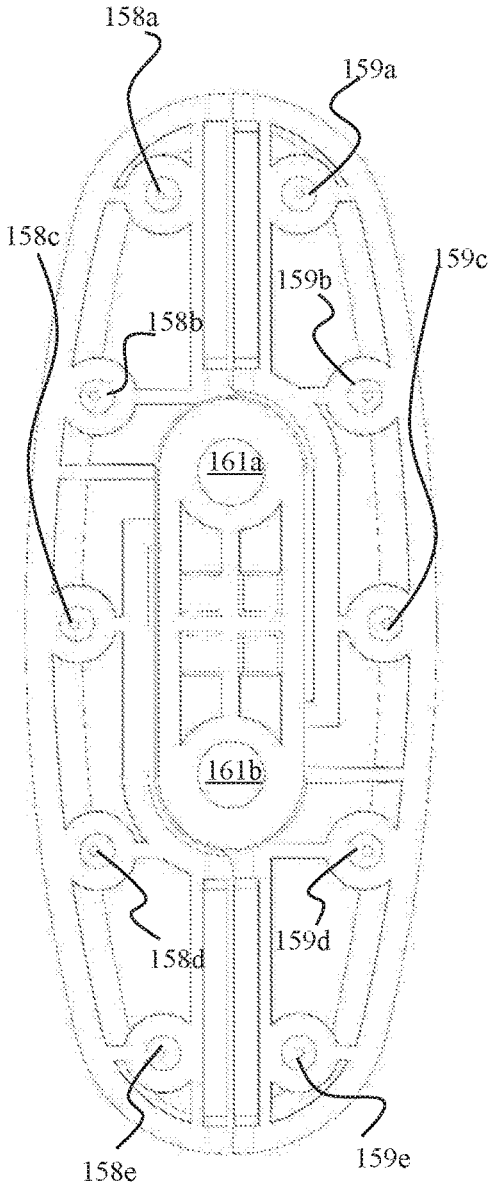
FIG. 16*a* shows an interior view of an exemplary hinge in a closed configuration.
Figure 16B:
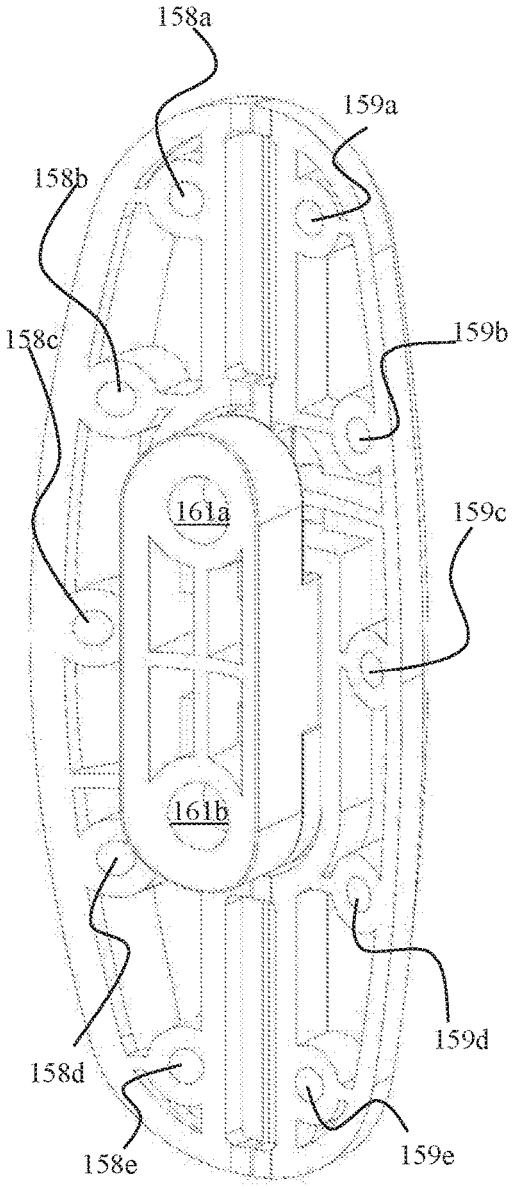
FIG. 16*b* shows an angled interior view of an exemplary hinge in a closed configuration.

FIGS. 16*a* and 16*b* are close-ups of the interior of upper hinge 150 when gun safe 100 is in a closed configuration. As shown in FIGS. 14*a* and 14*b*, from the exterior of gun safe 100, upper hinge 150 may comprise rotating cap components 151*a* and 151*b* and middle-stationary component 152.

Figure 17A:
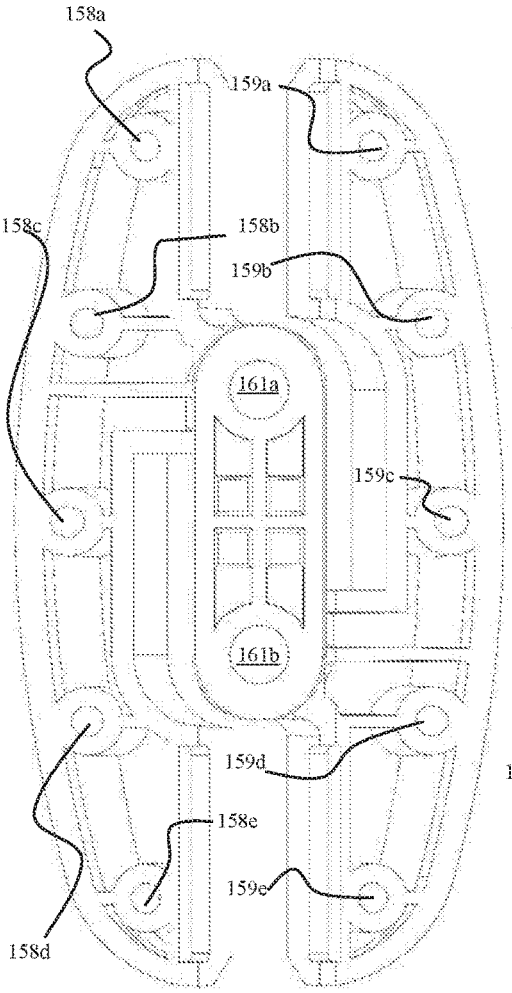
FIG. 17*a* shows an interior view of an exemplary hinge in an open configuration.
Figure 17B:
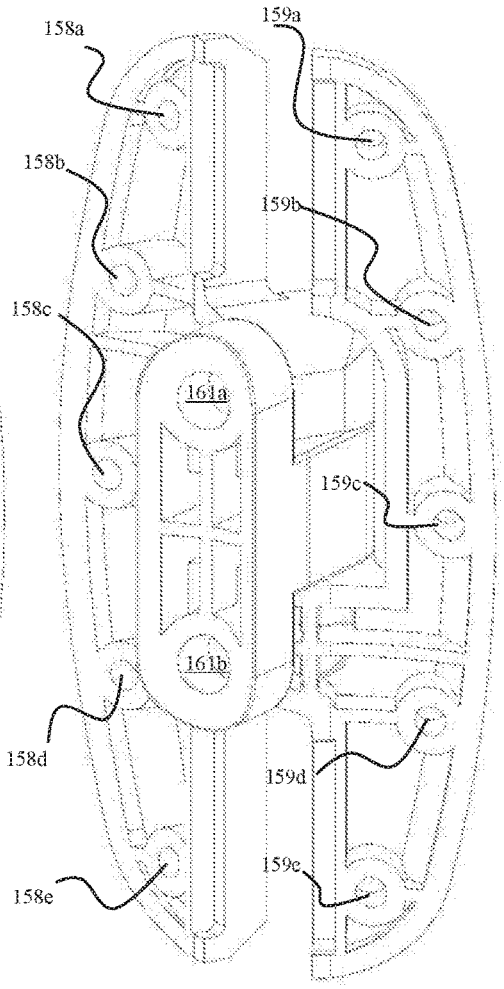
FIG. 17*b* shows an angled interior view of an exemplary hinge in an open configuration.

FIGS. 17*a* and 17*b* are close-ups of the interior of upper hinge 150 when gun safe 100 is in an open configuration.

One of first rotating cap component 151*a* and second rotating cap component 151*b* may be secured to right shell adapter 154*a*, and the other rotating cap component 151*b* may be secured to left shell adapter 153*a*.

A hinge pin 155 (not visible in FIGS. 9*a*, 9*b*, 14*a*-16*b*) may run through first rotating cap component 151*a* and second rotating cap component 151*b* and middle-stationary component 152 so that left shell adapter 153*a* and right shell adapter 154*a* are rotatably secured to each other and to support tube 130 as described herein below.

Figure 9A:
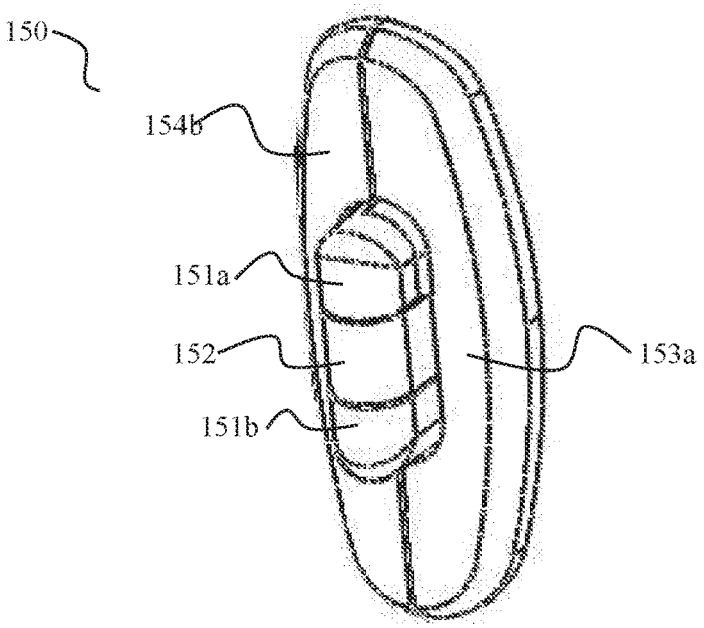
FIG. 9*a* shows an exterior angle view of an exemplary hinge.
Figure 9B:
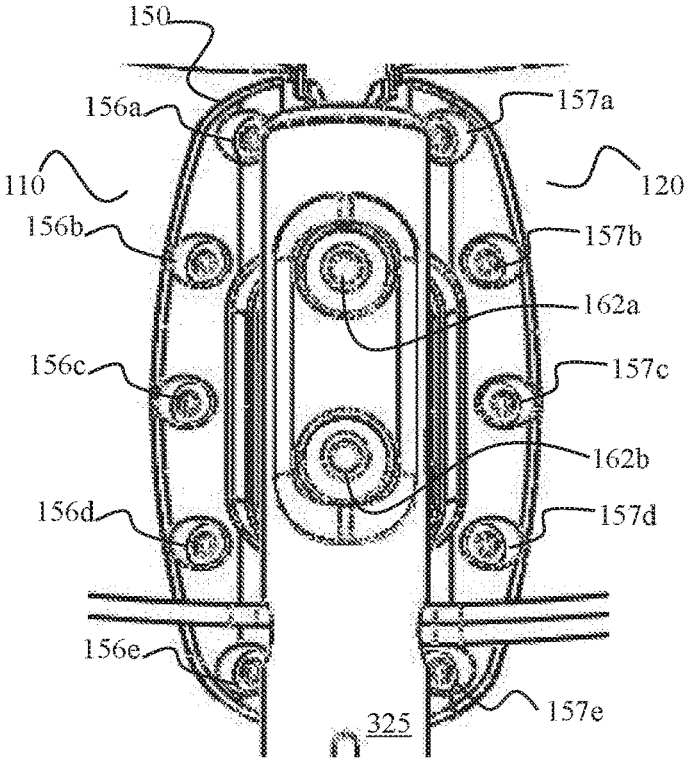
FIG. 9*b* shows an interior view of an exemplary hinge secured to a spine.

As shown in FIG. 9*b*, in one embodiment, left shell 110 may be secured to left shell adapter 153*a* using screws 156*a-e*, inserted through corresponding holes 158*a-e* in interior left shell adapter plate 153*b*, shell 110, and into corresponding threaded receivers in left shell adapter 153*a*. Right shell 120 may be similarly secured to right shell adapter 154*a* using interior right shell adapter plate 154*b*, screws 157*a-e*, and corresponding holes 159*a-e* in interior right shell adapter plate 154*b*.

As shown in FIG. 9*b*, upper hinge 150 may be secured to support tube 130 using bolts 162*a* and 162*b* secured through corresponding holes 161*a* and 161*b* (as shown in FIGS. 16*a* and 16*b*) in upper hinge 150 and into corresponding threaded receivers 324*a* and 324*b* (shown in FIG. 12*a*) in support tube 130.

Lower hinge 165 may be secured to support tube 130, left shell 110, and right shell 120 in a manner similar to securement of upper hinge 150.

A person of ordinary skill in the art will appreciate and understand that, as described herein, components may be secured to each other in many different ways, using many different types of hardware, using different numbers of screws, bolts, and other hardware, and well as other approaches to securing components known in the art.

Usage of multiple hinges, e.g., upper hinge 150 and lower hinge 165, is optional. A person of ordinary skill in the art will recognize that only a single hinge may be used to enable the desired relative motion between first shell member 110 and second shell member 120.

Locking Mechanisms

Figure 8A:
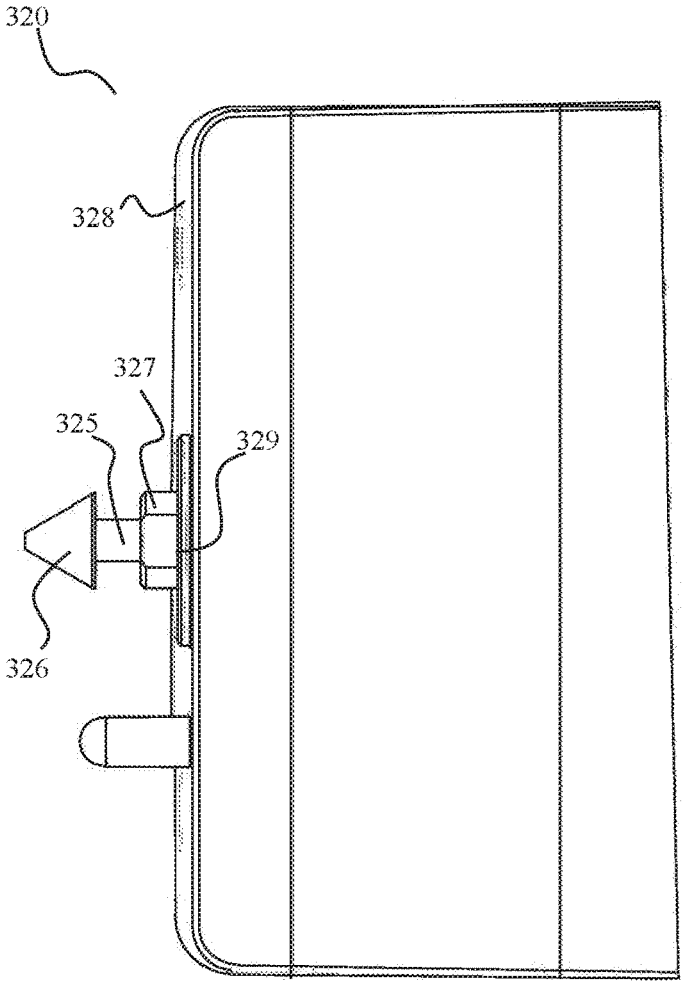
FIG. 8*a* shows a profile view of an exemplary locking mechanism.

FIG. 8*a* shows a detailed profile view of upper lock assembly 320. This disclosure does not limit the particular locking mechanism that may be used for upper lock assembly 320. Many locking mechanism assemblies other than the lock assembly disclosed herein may be used and may be associated with different benefits or applications.

Upper lock assembly 320 may comprise a shaft 325 terminating in a substantially conical head 326. Shaft 325 and conical head 326 may protrude from lock assembly 320 as shown in FIGS. 6 and 8*a*, from a point of securement inside lock assembly 320 and through aperture 329 in face 328 of lock assembly 320.

Shaft 325 may be held in place by being screwed or bolted into a receiver in lock assembly housing 320, or by being secured to shell 120, or by any one of many solutions or approaches known in the art for securing a part or piece of hardware to another component.

Figure 8B:
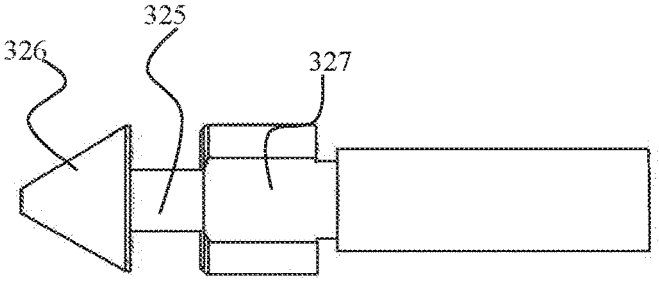
FIG. 8*b* shows a profile view of a shaft for an exemplary locking mechanism.

Shaft 325 may additionally comprise a guide collar 327 for maintaining the position of shaft 325 relative to aperture 329 in face 328 of lock assembly, i.e., avoiding potential displacement resulting from flexing or other characteristics of lock assembly 320 or of securement point for securing shaft 325 to lock assembly 328 or to shell 120. FIG. 8*b* shows a detailed view of an exemplary shaft 325 with conical head 326 and guide collar 327.

Figure 19:
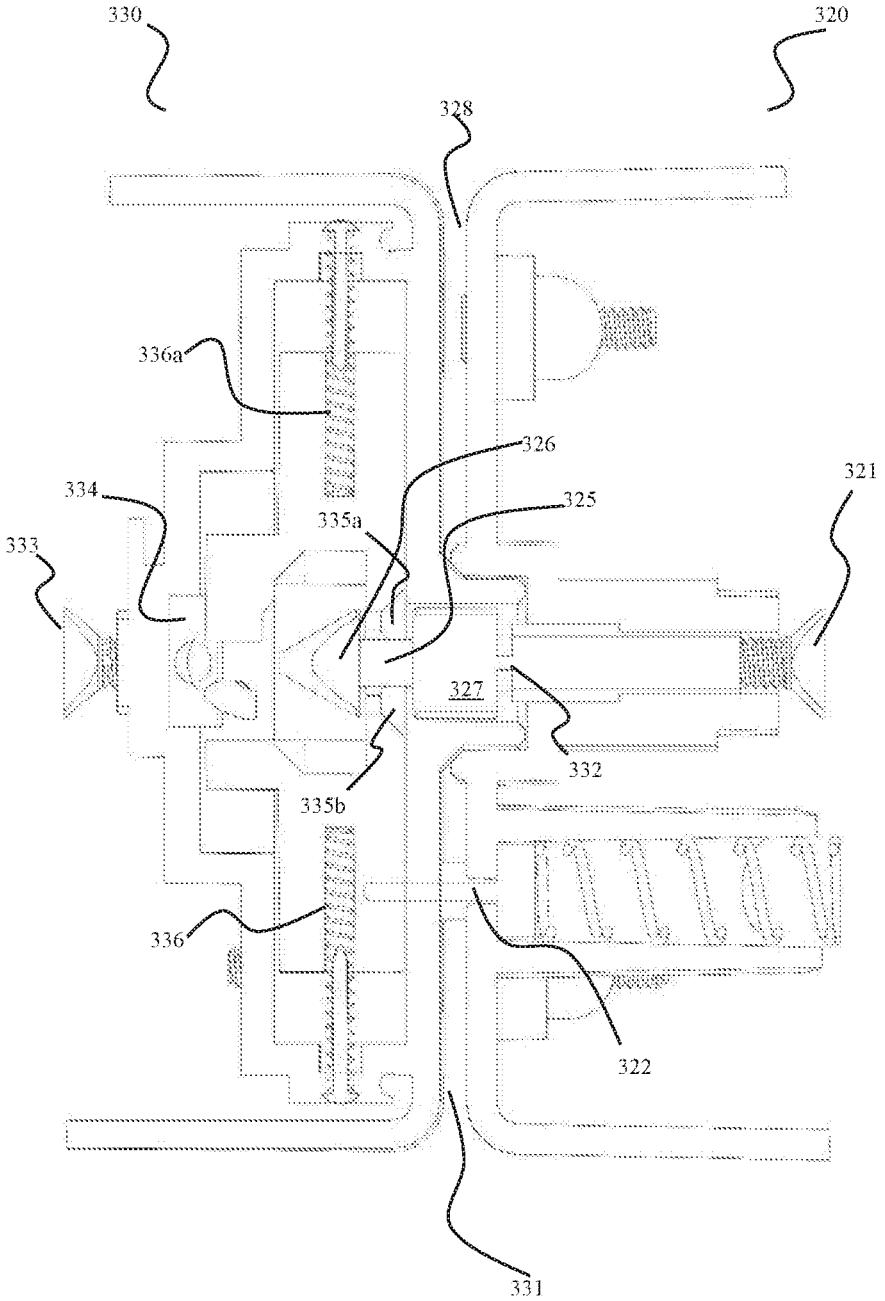
FIG. 19 shows a detailed profile cross-section view of an exemplary locking mechanism.

Upper lock assembly 320 may be secured to shell 120 by, e.g., one or more screws originating from outside shell 120 and going into one or more threaded receivers in upper lock assembly 320. For example, screw 321 may be inserted from outside of shell 120, through a hole in shell 120, and into a threaded receiver in upper lock assembly 320. It should be appreciated that many different means known in the art may be used to secure upper lock assembly 320 to shell 120. Lock assembly may be secured in place, and/or to outside shell 120, in many other ways as will be appreciated by a person of ordinary skill in the art FIG. 19 shows a detailed view of one embodiment of upper lock assembly 320 and upper lock receiver assembly 330. Upper lock receiver assembly 330 may comprise a face 331, aperture 332 in face 331, a threaded receiver for screw 333, a rotating motor 334, and clasping semi-circles 335*a* and 335*b*.

Clasping semi-circles 335*a* and 335*b* may be secured to or in contact with a springs 336*a* and 336*b* or similar components in lock receiver assembly 330, which exert a force on clasping semi-circles 335*a* and 335*b* to push them toward each other such that they substantially form a circle. In one embodiment, clasping semi-circles may be positioned and secured to sit behind aperture 332. Aperture 332 may be a hole with a diameter that is the same as or greater than the diameter of the base of conical head 326, such that conical head 326 on shaft 325 may be inserted into aperture 332. The radius of clasping semi-circles 335*a* and 335*b* may be substantially the same as, but in no case less than, the radius of shaft 325.

When shaft 325 and conical head 326 are inserted into aperture 332, the conical shape of conical head 326 forces apart clasping semi-circles 335*a* and 335*b*. When the entirety of conical head 325 has been pushed through clasping semi-circles 335*a* and 335*b*, then the springs 336*a* and 336*b* associated with clasping semi-circles 335*a* and 335*b* force clasping semi-circles 335*a* and 335*b* to contract and tighten into a substantially circular shape around shaft 325, as shown in FIG. 19. In this state, shaft 325 cannot be removed from upper lock receiver assembly 330 because the base of conical head 326 cannot pass the circle, around shaft 325, formed by clasping semi-circles 335*a* and 335*b*. When shells 110 and 120 are pushed, forced, or otherwise moved together, toward or into a closed configuration, shaft 325 is inserted into and pushes apart clasping semi-circles 335*a* and 335*b* and, as described above, when conical head 326 has completely passed through clasping semi-circles 335*a* and 335*b*, clasping semi-circles 335*a* and 335*b* contract toward each other and gun safe 100 enters a closed or locked configuration.

To release the locking mechanism, rotating motor 334, which may be a servo motor, turns to push apart clasping semicircles 335*a* and 335*b*. When clasping semi-circles 335*a* and 335*b* have been pushed apart sufficiently, then conical head 326 is able to pass, base-first, through clasping semi-circles 335*a* and 335*b* and out of aperture 332. When clasping semi-circles 335*a* and 335*b* have been pushed apart, shaft 325 and conical head 326 may be removed from upper lock receiver assembly 330 and aperture 332 by applying a force to pull or otherwise move apart shells 110 and 120. In one embodiment, as described herein, spring-loaded pin 322 may apply a force to push apart shells 110 and 120. As will be appreciated, many different mechanisms other than a traditional spring may be used to apply force to push apart shells 110 and 120.

Servo motor 334 may be configured to turn sufficiently to release conical head 326 on shaft 325 and then automatically turn back (or forward in some configurations of clasping semi-circles 335*a* and 335*b*) to a closed position, i.e., such that clasping semi-circles 335*a* and 335*b* are contracted around.

Lower lock assembly 340 and lower lock receiver assembly 350 comprise components similar to components in upper lock assembly 320 and upper lock assembly 330, and function in a substantially similar manner, and are therefore not distinctly described herein.

Although the embodiment described herein and shown in the associated figures includes two lock assemblies (upper lock assembly and receiver 320 and 330; lower lock assembly and receiver 340 and 350), a different number of lock assemblies may be used depending on the characteristics of a particular gun safe or of a different application for a secured compartment or enclosure. The number of lock assemblies, and the placement of such lock assemblies, may depend on at least length of the seam between the shells, the shape of the shells, the size and placement of the hinges, the manufacturing tolerances of the shells, flexibility, of the shells, and other characteristics of the shells.

In one embodiment, one or more dampeners and/or other motion slowing devices may be incorporated into shells 110 and 120 to control the speed at which shells 110 and 120 move to the open configuration.

Sensor System

Figure 20:
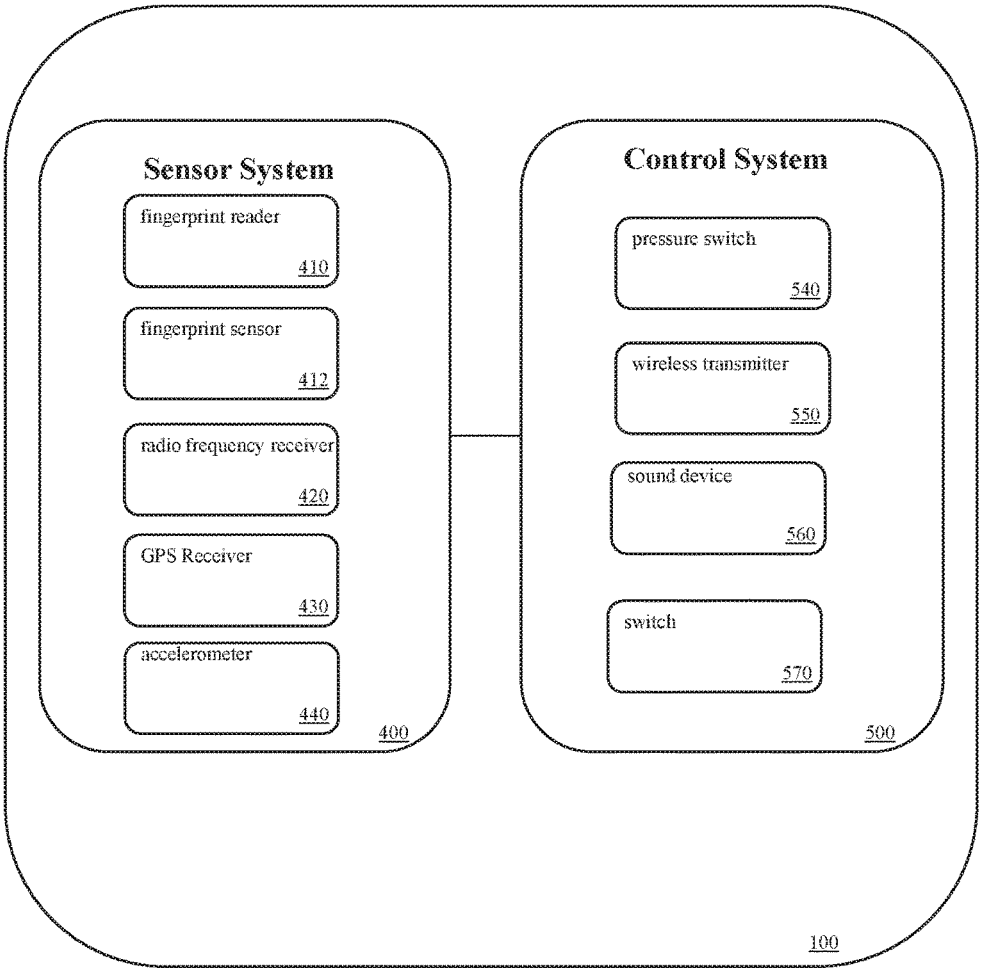
FIG. 20 shows a conceptual view of a sensor system and control system for an exemplary gun safe.

As shown in FIG. 20, gun safe 100 may have a sensor system 400 that detects signals, events, and/or objects outside gun safe 100. Sensor system 400 may be used to simply provide data for a user of gun safe 100. Additionally or alternatively, sensor system 400 may control access to gun safe 100, e.g., by detecting signals and/or biometric data from an authorized user. Additionally or alternatively, sensor system 400 may provide notification to an authorized user in the event of use, theft, and/or tampering involving gun safe 100.

Sensor system 400 may include one or more sensors of a wide variety of types, including but not limited to wireless sensors that detect wireless signals, biometric sensors that detect one or more characteristics of a user, motion sensors that detect motion or movement of the gun safe 100, combinations thereof, and/or any other sensor type known in the art. Wireless sensors may detect signals such as electromagnetic radiation at one or more positions on the electromagnetic spectrum (including but not limited to radio frequency (RF), microwave, infrared, and visible light), air pressure variance such as that created by sound or motion, and/or any other known wireless signal type. Biometric sensors may detect biological data such as the patterns on a person's fingertips, hands, feet, or eyes; the thermal emissions of a person; the unique sound of a person's voice; and/or other biological data known in the art. Motion sensors may detect linear displacement, linear acceleration, rotational displacement, rotational acceleration, and any/or other motion characteristics. Sensor system 400 may include one or more sensors of any of these types and/or any other types known in the art.

Sensor system 400 may be located within shells 110 and 120. As shown in FIG. 20, gun safe 100 may also have a control system 500 that receives sensor data from sensor system 400. Control system 500 may control the transmission of one or more notifications to or from a user regarding the status of gun safe 100, or may initiate opening and/or unlocking of shells 110 and 120 when the proper credentials are presented. Control system 500 may also be generally contained within shells 110 and 120.

Gravity-Assisted Open

In one embodiment, gun safe 100 may employ gravity powered, or gravity assisted, opening. As shown in FIGS. 1-3, gun safe 100 may be oriented so that rear 104 of gun safe 100 is oriented at an angle relative to base plate 210. In one embodiment, although not necessarily in all embodiments, gun safe 100 may be positioned for use such that base plate 210 is substantially horizontal, i.e., resting on a horizontal surface such as a floor. Gun safe 100 may be oriented such that back 104 is not perpendicular to base plate 210, but instead is angled, tilted, or leaned backwards, i.e., such that, as viewed from the front as in FIG. 4, the bottom of gun safe 100 protrudes further toward the front that the top of gun safe 100. This angling, or tilting, or orientation, is also shown in FIG. 2.

As described herein regarding the locking mechanism, the respective fronts of shells 110 and 120 are secured together in a closed position via locking mechanism 300. When locking mechanism 300 is released, shells 110 and 120 are free to turn on hinges 150 and 165. Because gun safe 100 and support tube 130 are angled at the top toward the rear 104 of gun safe 100, shells 110 and 120 will, as a result of gravity and the respective center of gravity of each of shells 110 and 120, rotate or turn toward an open configuration as shown in FIGS. 6 and 7.

In one embodiment, as a result of friction in hinges 150 and 165, as well as imperfect manufacturing tolerances and other real-world imperfections, shells 110 and 120 may not automatically move toward an open position when locking mechanism 300 is released, or may move more slowly than desired toward an open configuration. To assist or provide a small boost to move shells 110 and 120 from a closed configuration to an open configuration when locking mechanism 300 is released, gun safe 100 may include springs or a similar mechanism to apply a force to push apart shells 110 and 120.

In one embodiment, shells 110 and 120 may include spring-loaded pins 322 and 342. Although spring-loaded pins 322 and 342 are shown as part of lock assemblies 320 and 340 in FIG. 6, it should be appreciated that a similar or substantially equivalent mechanism—for applying a force to separate shells 110 and 120 in front 102 of gun safe 100—may be included through many means, e.g., spring, elastic, motor, etc., known in the art. Spring-loaded pins 322 and 342 may be located at or incorporated into gun safe 100 in various locations and in various manners. In the embodiment shown in FIG. 6, spring-loaded pins 322 and 342 are included in lock assemblies 320 and 340 such that in the rest state, when gun safe 100 is in the open configuration as shown in FIG. 6, spring loaded pins 322 and 342 protrude from the respective faces of lock assemblies 320 and 340. Spring-loaded pins 322 and 342 may be oriented so that, when protruding from respective faces of lock assemblies 320 and 340, spring-loaded pins 322 and 342 contact the respective faces of lock receiver assemblies 330 and 350 at, or around, strike locations 323 and 343.

When spring-loaded pins 322 and 342 contact strike locations 323 and 343, the respective springs in spring-loaded pins 322 and 342 are pushed back, or recessed, into receiving cavities in lock assemblies 320 and 340. When spring-loaded pins 322 and 342 are pushed into, or recessed, into receiving cavities in lock assemblies 320 and 340, the respective springs are compressed. When gun safe 100 is maintained in a locked configuration, or in a configuration such that fronts of shells 110 and 120 are close enough together such that one or more of spring-loaded pins 322 and 342 are in contact with strike locations 343 and 350, the respective springs may be in a compressed state.

Because the springs for spring-loaded pins 322 and 342 are in a compressed state, when gun safe 100 is in a closed state, as lock assemblies 320 and 340 are released, the compressed springs apply a force against strike locations 323 and 343, thereby pushing shells 110 and 120 apart. Because of the angled orientation of gun safe 100 relative to base 200, once force from spring-loaded pins 322 and 342 has been applied, shells 110 and 120 move apart, assisted by the force and by gravity, into an open configuration as shown in FIGS. 6 and 7.

Shells 110 and 120 finally arrive at a resting open state when their respective gravity-powered motion is restricted by the design of hinges 150 and 165. A person of ordinary skill will appreciate that hinges 150 and 165 may be designed to limit, restrict, or stop movement of shells 110 and 120 at any point in the turning, travel, or outward rotation of shells 110 and 120.

Several parameters may be adjusted or tuned based on particular applications. For example, the angle at which support tube 130 is oriented relative to base 200 may be increased or decreased to increase or decrease the speed, or ease, at which shells 110 and 120 open, or move to an open configuration, or to increase or decrease the accessibility of the contents of gun safe 100. Spring-loaded pins 322 and 342 may be adjusted, such as: by using a stronger or weaker spring; increasing the circumference or length of the springs; pre-compressing or pre-stretching the springs; or any other adjustment known in the art, which may increase or decrease the force exerted by spring-loaded pins 322 and 342 increase or decrease the rotational length over which force is exerted by spring-loaded pins 322 and 342 exerted, increase or decrease the time duration over which force is exerted by spring-loaded pins 322 and 342, or alter the function of force over time or rotational length exerted by spring loaded pins 322 and 342.

Power Management

Referring to FIG. 20, if desired, switch 570 may be used to further control how gun safe 100 can be opened. For example, switch 570 may be used to shift gun safe 100 to a power-saving mode in which radio frequency receiver 420 is disengaged. Radio frequency receiver 420 may consume significantly more electrical power than fingerprint reader 410 due to the fact that fingerprint reader 410 may be activated only when pressed by the user's finger or thumb. Radio frequency receiver 420, by contrast, may transmit a continuous or intermittent signal to determine whether the radio frequency key is present. Thus, disabling radio frequency receiver 420 may conserve considerable power while still permitting the authorized user to obtain access to gun safe 100.

Gun safe 100 may have an internal battery (not shown) which may be rechargeable, and may be charged when charging/power interface 230 is connected to an external power source. It may be desirable to disconnect gun safe 100 from the external power source, for example, to transport gun safe 100. Using switch 570 to engage the power-saving mode may help to extend the life of the internal battery in such situations. If desired, the power-saving mode may also disable GPS receiver 430 or shift GPS receiver 430 into a power-saving mode with less frequent location scanning.

Electronics, Control System, and Sensor System

Figure 11:
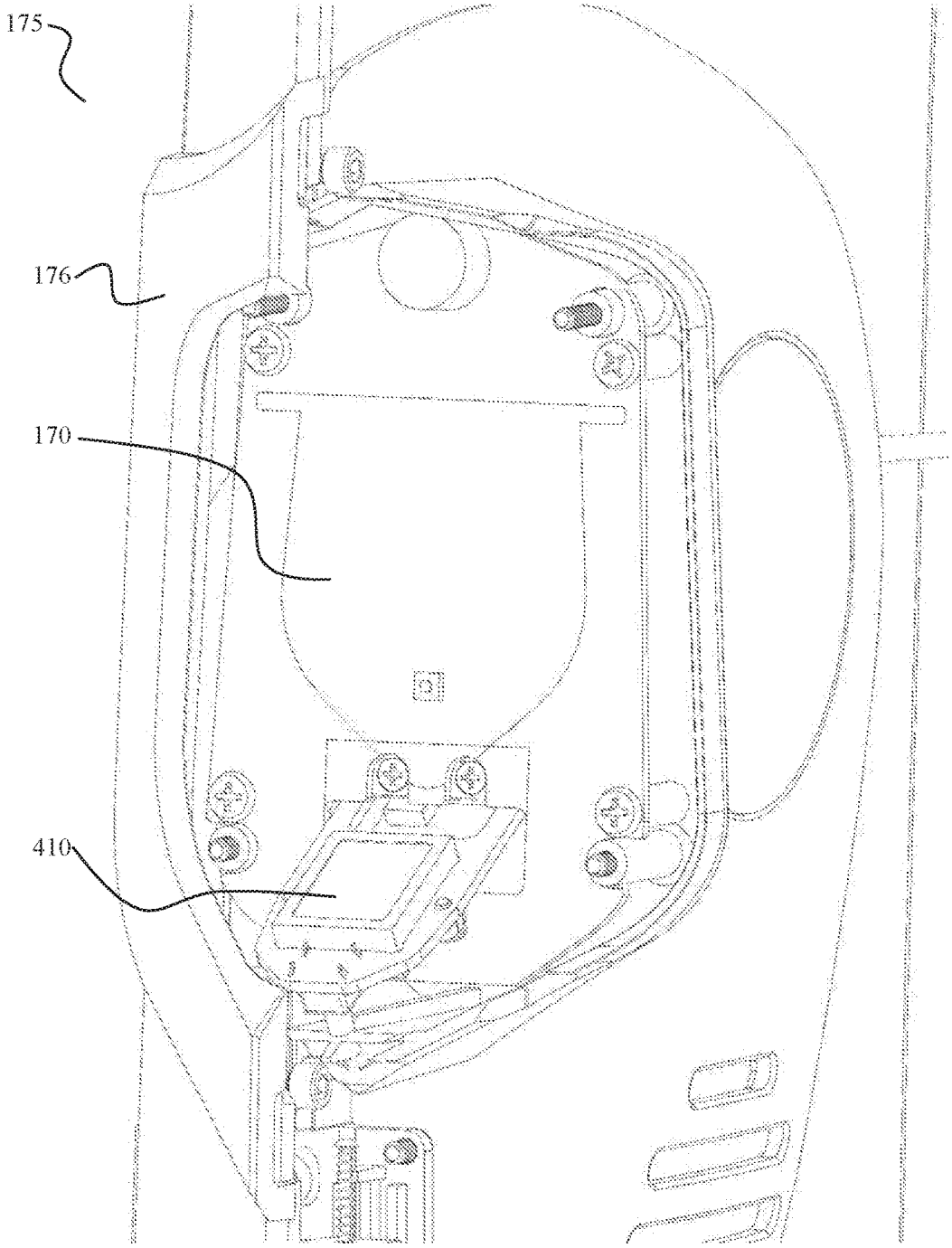
FIG. 11 shows a front angle view of an exemplary signal permeable layer.

FIG. 11 shows a close-up view of signal permeable layer 170. In one embodiment, one or more circuit boards for sensors for sensor system 400, or electronic components for control system 500, may be secured behind signal permeable layer 170. As is well known in the art, components for sensor system 400 and control system 500 may be located on one or more circuit boards or in other electronic components. For example, control system 500 may comprise at least a processor, memory with instructions stored thereon, memory for storing data, and a bus or other communications technology for the various components to communicate with each other.

Control system 500 may further include communication modules, e.g., a GPS communication module, a Wi-Fi communication module, a Bluetooth communication module, and RFID communication module, an NFC communication module, and/or any other type of communication module that may be known in the art.

These communication modules may be positioned behind signal permeable layer 170, so that the metal in shells 110 and 120 does not interfere with reception and transmission of wireless signals. A person of ordinary skill in the art will appreciate that the closer the communication modules, including the associated receivers and antennas, are to being flush with signal permeable layer 170 the better reception of wireless signals will be. This results because signals arriving at an angle that deviates from being perpendicular to signal permeable layer 170 will be less likely to be obstructed by shell 110. For similar reasons, as communication modules, including associated receivers and antennas, are recessed deeper into gun safe 100, i.e., behind signal permeable layer 170, the greater the likelihood that wireless signals approaching from an angle deviating from perpendicular to signal permeable layer 170 will be obstructed or partially obstructed by the metal or other materials in shells 110 and 120.

Gun safe 100 may further include a biometric sensor. In one embodiment, as shown in FIG. 20, the biometric sensor may be fingerprint sensor 412, which may be in communication with exposed fingerprint reader 410. Fingerprint reader 410 may be exposed through an aperture, or cut-out, in shell 110 or shell 120, or may be exposed through an aperture in signal permeable layer assembly 175. Fingerprint reader 410 may be a wireless sensor in addition to a biometric sensor because it may receive and read electromagnetic radiation, e.g., visible light, from a finger or thumb of the user. This light may be a reflection of light emitted by fingerprint reader 410 itself onto the user's digit and then into fingerprint reader 410.

As shown in FIG. 20, gun safe 100 may include a radio frequency receiver 420, which may receive a wireless signal emitted by and/or reflected by a wireless key, such as a radio frequency (RF) key. The radio frequency key may be coded to gun safe 100 so that a specific key (or set of keys) is needed to open gun safe 100, i.e., by opening, or unlocking, shells 110 and 120. The radio frequency key may be attached to an object, e.g., as a sticker or decal, or may be permanently embedded in an object. Thus, the radio frequency key may easily be part of a ring, a bracelet, or another object carried by the authorized user to enable the authorized user to easily open gun safe 100 by opening, or unlocking, shells 110 and 120. As described herein, radio frequency key 420 may be integrated with, included in, or in communication with control system 500.

Gun safe 100 may further include a communication module with a receiver for receiving signals to indicate the location of gun safe 100, e.g., a GPS receiver 430. GPS receiver 430 may receive GPS signals from GPS satellites that may enable GPS receiver 430 and/or control system 500 to determine the location coordinates (for example, latitude, longitude, and/or elevation) of gun safe 100. GPS receiver 430 may thus provide sensor data including the location of gun safe 100.

In one embodiment, one or more circuit boards comprising the components of control system 500, including, e.g., communication modules as described herein, may be secured to signal permeable layer assembly 175. To minimize the possibility that a person may be able to compromise gun safe 100 through signal permeable layer 170, signal permeable layer 170 and/or signal permeable layer assembly 175 may be made out of a durable material, e.g., a rugged polymer such as nylon.

Signal permeable layer assembly 175 may be secured to shell 110 by adapter 176, as shown in FIGS. 2, 4, and 11. In one embodiment, adapter 176 may comprise two complementary components—an exterior adapter and an interior adapter. Adapter 176 may be secured to shell 110 by inserting one or more screws through holes in the interior adapter, through corresponding holes in signal permeable layer assembly 175, through corresponding holes in shell 110, and into corresponding threaded receivers in the exterior adapter. Because the screws are accessible only from the interior of gun safe 100, gun safe 100 cannot be compromised in its closed/locked configuration by accessing and removing the screws securing signal permeable layer assembly 175.

Although the disclosure herein describes a signal permeable layer assembly 175 secured to shell 110, in other embodiments shell layer 110 may include one or more apertures designed, sized, and tuned for receiving and transmitting wireless signals to and from communication modules. In other words, instead of, or in addition to, a signal permeable layer assembly 175, shell 110 may simply extend across what is shown as signal permeable layer assembly 175, with apertures for wireless signals, and perform essentially the same functions as signal permeable layer 175: protecting and securing the interior of gun safe 100 while allowing wireless signals to pass to and from the communication modules.

Because fingerprint reader 410 is exposed on the exterior of gun safe 100, any aperture or signal permeable layer for fingerprint functionality may be relatively small, i.e., just large enough to expose fingerprint reader 410.

In one embodiment, fingerprint sensor 412 may be activated by pressure from a digit (finger or thumb) so that, when the user puts a finger or thumb on fingerprint sensor 412, fingerprint sensor 412 automatically emits light and reads the reflected light from the finger or thumb. Fingerprint sensor 412 may also have a circuit board 510 which controls the operation of fingerprint sensor 412, processes sensor data from fingerprint sensor 412, and/or conveys sensor data, such as fingerprint data or other data, to one or more other components of gun safe 100, such as to control system 500.

In one embodiment, control system 500 may include a pressure switch 540 that can be accessed when gun safe 100 is in the open configuration. Pressure switch 540 may be used to enable the user to activate various settings of control system 500, as will be detailed subsequently.

Sensor system 400 may also include an accelerometer 440, which may be located on the one or more circuit boards as described herein, or on a separate circuit board or chip. Accelerometer 440 may detect acceleration of gun safe 100. Thus, accelerometer 440 may provide sensor data that indicates when gun safe 100 is in motion, such as a person opening up, picking up, shaking, striking, rotating, flipping over, hitting, or carrying gun safe 100.

Accelerometer 440 may thus provide an indication of ordinary use, tampering, and/or theft of gun safe 100. Accelerometer 440 and/or control system 500 may have a sensitivity level that matches the type of events that should be reported to the authorized user. For example, if the authorized user wants to receive notification whenever gun safe 100 is opened or undergoes any motion, accelerometer 440 may be set to a very sensitive level. However, if the authorized user wants to receive notification only if gun safe 100 is impacted, as may occur if gun safe 100 is dropped or struck in an attempt to gain entry, accelerometer 440 may be set to a less sensitive level.

Accelerometer 440 may measure linear acceleration, angular acceleration, or both linear and angular acceleration. In the event accelerometer 440 detects more than one type of motion, control system 500 may be designed to trigger alarms based on thresholds that are specific to each type of motion. Such thresholds may be based on linear and/or angular acceleration, velocity, and/or position. Velocity and position may be determined by integrating, or otherwise extrapolating, acceleration data.

According to one example, the threshold linear acceleration may be a multiple of the gravitational constant (9.81 $m/s^2$). If the threshold linear acceleration is equal to or just below the gravitational constant, accelerometer 440 may not trigger any alarms or notifications unless gun safe 100 is falling. Thus, it may be desirable to set the threshold linear acceleration at a lower level, such as 5 $m/s^2$, 2 $m/s^2$, 1 $m/s^2$, 0.5 $m/s^2$, or 0.25 $m/s^2$.

As mentioned previously, velocity or position may be used in addition to or in the alternative to acceleration. In the context of angular position, the threshold angular position may be set at a certain tilt angle that will indicate tampering, or deliberate motion, of gun safe 100 are occurring. For example, the threshold angular position change may be 1°, 2°, 5°, 10°, 20°, 30°, 45°, 60°, 75°, or even 90°. Any of the threshold angular positions applicable to accelerometer 440 may be user-configurable, if desired.

Gun safe 100 may also have a wireless transmitter 550. As mentioned previously, gun safe 100 may communicate wirelessly via a wide range of technologies, including Wi-Fi, Bluetooth, Bluetooth Smart, near-field communications (NFC), cellular, radio frequency (RF), infrared (IR), and the like. Wireless transmitter 550 may be designed to communicate along any of these protocols, or on any other type of wireless technology or network technology known in the art.

According to certain embodiments of the invention, wireless transmitter 550 may be designed to connect to a Wi-Fi system such as those found in many homes. Wireless transmitter 550 may thus transmit notifications and/or other information to the Wi-Fi system, which may convey the information to an electronic device, which may be near the authorized user, via the Internet. This electronic device may be a computer, tablet, phone, smart phone, or the like. The notification may take the form of a text message, e-mail message, automated phone call, or the like.

Transmitting the notification to the electronic device near the authorized user may entail transmitting the information to a server, which may be maintained by the manufacturer of gun safe 100. The server may store user-specific data regarding gun safe 100 owned by the user, such as the identity of the authorized user; the authorized user's preferred mode of receiving notifications; the applicable IP address, mobile phone, MAC address, or other identifier of the electronic device with which the authorized user wishes to receive notifications; the location of gun safe 100, and/or other information.

In some embodiments, the server may store only enough information to properly route the notification to the electronic device near the authorized user. In such embodiments, the location of gun safe 100, the identity of the authorized user, and/or other personal information may be omitted from the server in order to satisfy privacy or other concerns.

In addition to, or alternatively, wireless transmitter 550, gun safe 100 may include sound device 560 such as a speaker, buzzer, and/or any other sound-producing device. Sound device 560 may be incorporated into the circuit boards as described herein, or may be a separate element.

Sound device 560 may be used to provide notification to the user of tampering, theft, or other aspects of the status of gun safe 100 via an audible alarm or tone. This may be done in addition to, or in the alternative to, the transmission of a wireless notification to the electronic device. According to some embodiments, the type of status change may determine the type of notification provided to the authorized user. For example, detection by accelerometer 440 of excessive acceleration may result in an audible notification, while detection by GPS receiver 430 that gun safe 100 has moved beyond an acceptable range, may result in transmission of an electronic notification.

In one embodiment, control system 500 may, based on a determination that proper credentials have been presented, trigger motor 334 (shown in FIG. 19) in upper lock receiver assembly 330, as well as in lower lock receiver assembly 350, to release the locking mechanism and initiate opening of gun safe 100.

Credentials for opening gun safe 100 may include an RFID identification number or code, credentials transmitted via Wi-Fi, credentials transmitted via Bluetooth, an NFC key, a verbal command, a proximity verification of distance from user to gun safe 100, or any other credentials, or method, for verifying the identity and/or authorization of a person known in the art.

In one embodiment, control system 500 may continuously scan for wireless signals, e.g., Wi-Fi, Bluetooth, RFID, NFC, or other technologies. When control system 500 detects a signal, control system 500 may process the received data to determine when the received data comprises credentials for accessing and/or opening gun safe 100. Upon a determination that received data comprises valid credentials, control system 500 may trigger motors in lock receiver assemblies to release locking mechanism and thereby open gun safe 100.

In another embodiment, control system 500 may save power by scanning for wireless signals only when activated, e.g., through the pressing of a button. For example, fingerprint reader 410 may comprise a button that, when pressed, causes control system 500 to scan, for a limited amount of time, e.g., 3.0 seconds, for a wireless signal comprising credentials for opening gun safe 100. Upon a determination that received data comprises valid credentials, control system 500 may trigger motors in lock receiver assemblies to release locking mechanism and thereby open gun safe 100.

Credentials for opening gun safe 100 may be configurable. For example, detection of the property fingerprint with fingerprint reader 410 may itself be sufficient, or detection of the proper RFID key may itself be sufficient, or detection of the proper a Wi-Fi key or code, or detection of a Bluetooth key or code may itself be sufficient to open gun safe 100. Alternatively, control system 500 may be configured so that proper credentials include both a proper fingerprint and an RFID key, or some other combination of credentials. Credentials may be configured using pressure switch 540, or through a control app or interface that may communicate with gun safe 100 through control system 500 and using one or more of the wireless communication modules and/or technologies disclosed herein.

As will be understood and appreciated by a person of ordinary skill in the art, the electronics for gun safe 100 may be located and configured in many different ways. In one embodiment, base boot cavity 222 may house a circuit board or similar electronics including charging/power interface 230. For example, electronics in base boot cavity 222 may include electronics for charging/power interface 230, and may also include rechargeable battery 240. The circuit board and/or electronics in base boot cavity 222 may originate two power wires: a wire 252 that is continually powered from rechargeable battery 240 and a wire 254 that is powered only when an external power source is connected to charging/power interface 230.

In one embodiment, power wires 252 and 254 may be routed through hollow support tube 130 up to an exit aperture in support tube 130 near the electronics for control system 500. FIG. 6 shows control wire 252 exiting support tube 130, routed across the back of shell 110 into a circuit board or electronics behind signal permeable layer 170. Motor control wire 255 may run from control system 500 along the inner edge of shell 110 to power motor 334 in upper lock receiver assembly 330 and the similar motor in lower lock receiver assembly 350 for powering movement of the motors for releasing lock mechanisms to open gun safe 100.

Accessory wire 254 may be used to power one or more accessories. In one embodiment, gun safe 100 may include Bluetooth speakers 270 and 272, which may be powered by an accessory wire or wires 254, and may be controlled via Bluetooth interface, e.g., through a smartphone app or other Bluetooth interface. Other accessories may also be added to gun safe 100 as may be desirable or to improve the functionality of gun safe 100.

Geofencing

Figure 21:
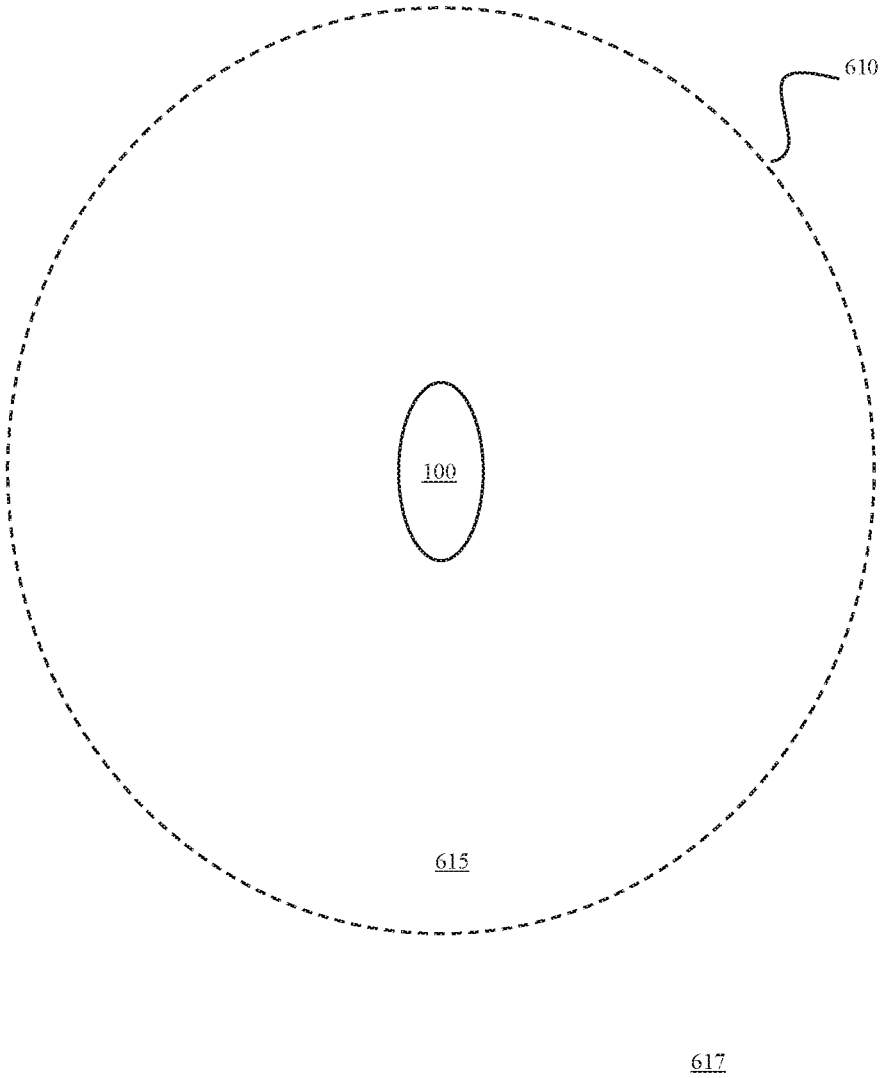
FIG. 21 shows an exemplary geofencing perimeter for a gun safe.

FIG. 21 shows a top elevation perspective view of gun safe 100 in the closed configuration, illustrating a perimeter 610 that defines an approved geographic zone 615. Geofencing and/or other technologies may be used to define approved geographic zone 615, in which gun safe 100 may be positioned without the need to transmit alerts to the authorized user. This may be accomplished in a wide variety of ways.

According to one example, when gun safe 100 is first configured, the authorized user may provide input to control system 500 in gun safe 100 to indicate that gun safe 100 is positioned at the center of approved geographic zone 615, i.e., the center of perimeter 610. This may be done through the use of a button or other interface on or in gun safe 100. For example, a user may open gun safe 100 to access a button and then hold down the button down for a predetermined period of time to record the location of gun safe 100. The location may be recorded in control system 500. Control system 500 may then record the location of gun safe 100 as the center of approved geographic zone 615, and determine perimeter 610 based on the location of the center.

This may be done, for example, by establishing perimeter 610 as a radius around the center such that perimeter 610 is generally circular, or spherical, in shape. This may provide approved geographic zone 615 with the same circular or spherical shape. In alternative embodiments, approved geographic zone 615 may have any known two-dimensional or three-dimensional shape, including any combination of flat and/or curved sides. If desired, stepped flat sides may be used to approximate a curved shape such as a circle or sphere.

Control system 500 may be programmed to receive sensor data including location of gun safe 100 from GPS receiver 430, which may periodically receive GPS signals to determine the location of gun safe 100, as known in the art. The location may include location coordinates, such as latitude, longitude, and/or elevation. Control system 500 may further be configured to notify the authorized user if control system 500 moves outside approved geographic zone 615 and into an unapproved geographic zone 617 positioned outside of perimeter 610.

Figure 13:
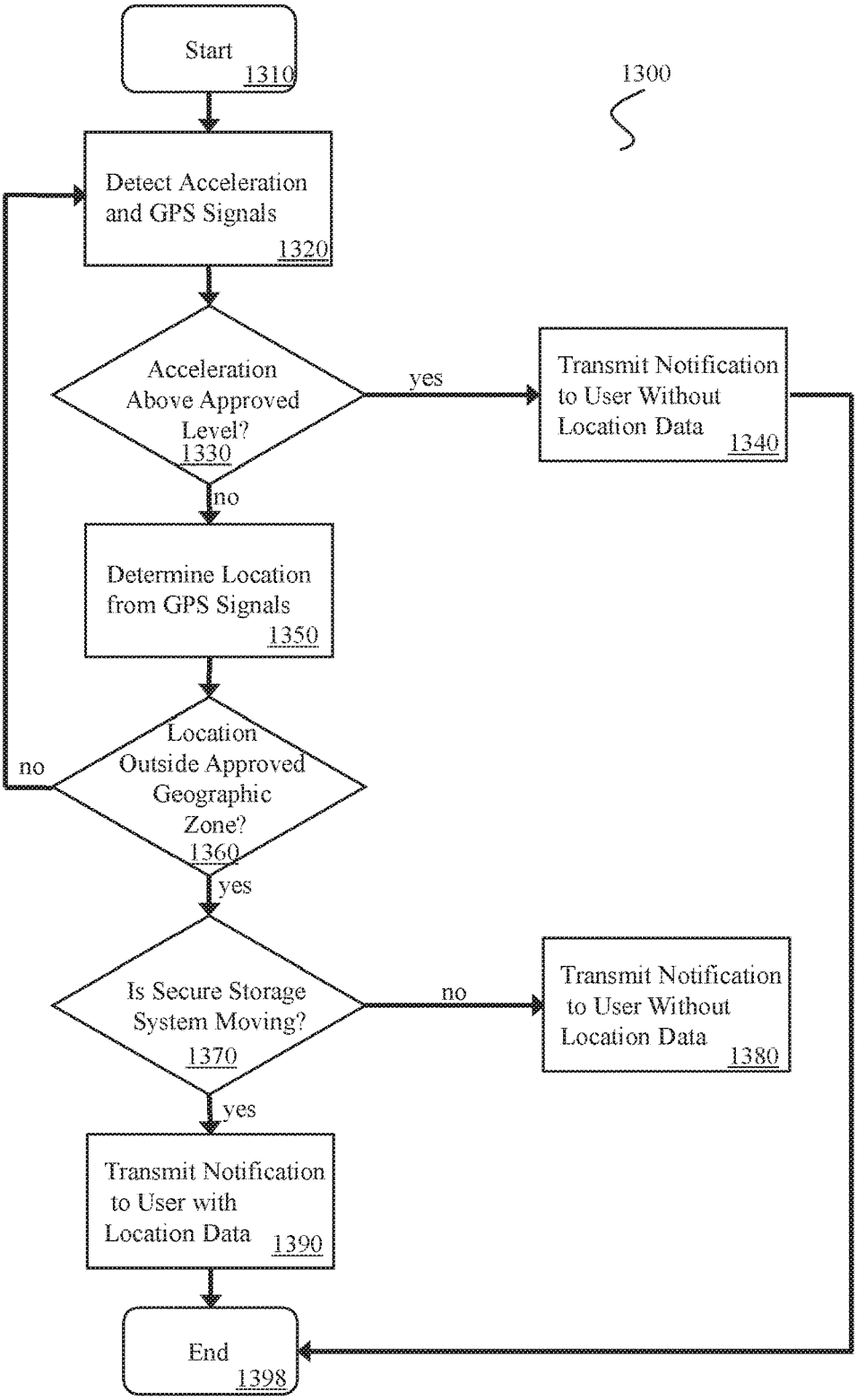
FIG. 13 shows a flowchart for an exemplary geofencing method as described herein.

Referring to FIG. 13, a flowchart diagram illustrates one method 1300 by which gun safe 100 may monitor its status and, if warranted, transmit a notification to an authorized user. Method 1300 may be carried out by software and/or hardware instructions of control system 500. If desired, control system 500 may be user-configurable to enable an authorized user to configure various aspects of method 1300.

Method 1300 may begin 1310 with step 1320 in which gun safe 100 detects acceleration and GPS signals. More specifically, accelerometer 440 may continuously and/or intermittently detect the acceleration level of gun safe 100 and transmit sensor data containing the acceleration level to control system 500. Similarly, GPS receiver 430 may continuously or intermittently receive GPS signals to detect the location of gun safe 100, and may transmit sensor data containing the location, e.g., the location coordinates, of gun safe 100 to control system 500.

Step 1320 may be carried out continuously or intermittently so that control system 500 receives continuous or period sensor data with the acceleration level and/or location of gun safe 100. Each time such sensor data is received, control system 500 may determine, in a determination 1330, whether the acceleration level of gun safe 100 exceeds the predetermined threshold, which may be an approved acceleration level. As mentioned previously, this approved acceleration level may be tuned to the type of events for which the authorized user desires notification, e.g., ordinary use, or only impact events.

If the acceleration of gun safe 100, as measured by accelerometer 440, has exceeded the approved acceleration level, method 1300 may proceed to a step 1340 in which control system 500 initiates the transmittal of a notification to the authorized user. The notification may be transmitted wirelessly to an electronic device, may be audible, or may take other forms, as desired. The notification may be a type designed for immediate receipt by the authorized user.

In alternative embodiments, the notification may not be received by the authorized user until later. For example, a light or other indicator in or on gun safe 100 may be activated to notify the authorized user, next time he or she opens or looks at gun safe 100, that an attempt at tampering or theft has occurred.

In some embodiments, the notification may be perceptible to those in the vicinity of gun safe 100. For example, an audible alarm may serve to scare away a person attempting to tamper with or steal gun safe 100. In alternative embodiments, the notification may be imperceptible to the person attempting to steal or tamper with gun safe 100. An electronic notification to the electronic device held by the authorized user may not be perceived by the person who took the actions that prompted the transmission of the notification. Thus, the person may be kept unaware that the authorized user knows of the tampering or attempted theft.

According to certain embodiments, the notification transmitted in the step 1340 may not include location data for gun safe 100. In the context of transmission of the notification via the Internet, the location data may be omitted for privacy reasons. The authorized user may not want other individuals to obtain access to the location of his or her firearms or valuables. If desired, the notification may include an indication of the acceleration level experienced by gun safe 100, the probable event that caused the acceleration, and/or other information that may help the authorized user to assess the level of risk to gun safe 100.

If, in the determination 1330 the acceleration of gun safe 100 has not exceeded the approved acceleration level, method 1300 may proceed to a step 1350 in which the location of gun safe 100 is determined based on the GPS signals received by GPS receiver 430. This may entail triangulation of the location coordinates of gun safe 100 based on the locations of the GPS satellites that transmit the GPS signals, as known in the art.

Once the location of gun safe 100 has been determined, method 1300 may proceed to a determination 1360 in which gun safe 100, for example, in control system 500, determines whether gun safe 100 is outside approved geographic zone 615. If gun safe 100 is still within approved geographic zone 615, control system 500 may conclude that gun safe 100 is not being stolen or tampered with, and may thus proceed back to step 1320 to continue gathering sensor data until an abnormal condition is found.

If the location of gun safe 100 is outside approved geographic zone 615, or if the location of gun safe 100 is within unapproved geographic zone 617, method 1300 may proceed to a determination 1370. In determination 1370, gun safe 100 determines, for example, in control system 500, whether gun safe 100 is moving. This determination may be made with acceleration data from accelerometer 440 and/or with location data from GPS receiver 430.

According to some examples, the current sensor data may be compared with previously obtained and/or processed sensor data to determine whether gun safe 100 is moving. For example, the current location of gun safe 100 may be compared with location data from the recent past. If the two are significantly different, it may be concluded that gun safe 100 is in motion. Sustained and/or repeated acceleration of gun safe 100 may similarly indicate that gun safe 100 is moving.

If the gun safe 100 is not deemed to be moving, method 1300 may proceed to step 1380 in which a notification is transmitted to the authorized user, again without location data. Like step 1340, step 1380 may entail transmission of an audible notification, an electronic notification, or any other notification type. The notification may be immediate or delayed, and may be perceptible or imperceptible to the person whose actions caused the notification to be sent.

If gun safe 100 is moving, method 1300 may proceed to a step 1390 in which the notification is transmitted to the authorized user with the location data. Like step 1340 and step 1380, this notification may take any of the forms mentioned previously. If gun safe 100 is moving, it may be assumed that privacy concerns are outweighed by the need to locate and recover gun safe 100; this may justify the inclusion of the location data in the notification.

After step 1340, step 1380, or step 1390 has been carried out, method 1300 may terminate with step 1398. If desired, no detection and/or notification steps may be undertaken until the authorized user performs an action to reset control system 500, for example, by presenting the proper credentials to gun safe 100. Alternatively, method 1300 may continue to iterate even after notification has been carried out in step 1340, step 1380, and/or step 1390. Sensor data may advantageously be logged for subsequent review by the authorized user regardless of whether a condition exists that warrants transmission of a notification. Thus, the authorized user can gain helpful information regarding the conditions to which gun safe 100 has been subjected.

Method 1300 is only one of many different implementations of the invention. Sensor system 400 may include any of a wide variety of sensor types, and the sensor data provided by sensor system 400 may be used to make notification decisions according to a wide variety of methods different from that of method 1300. Such methods will be envisioned by a person of skill in the art with the aid of the present disclosure.

Sneakers

Figure 18:
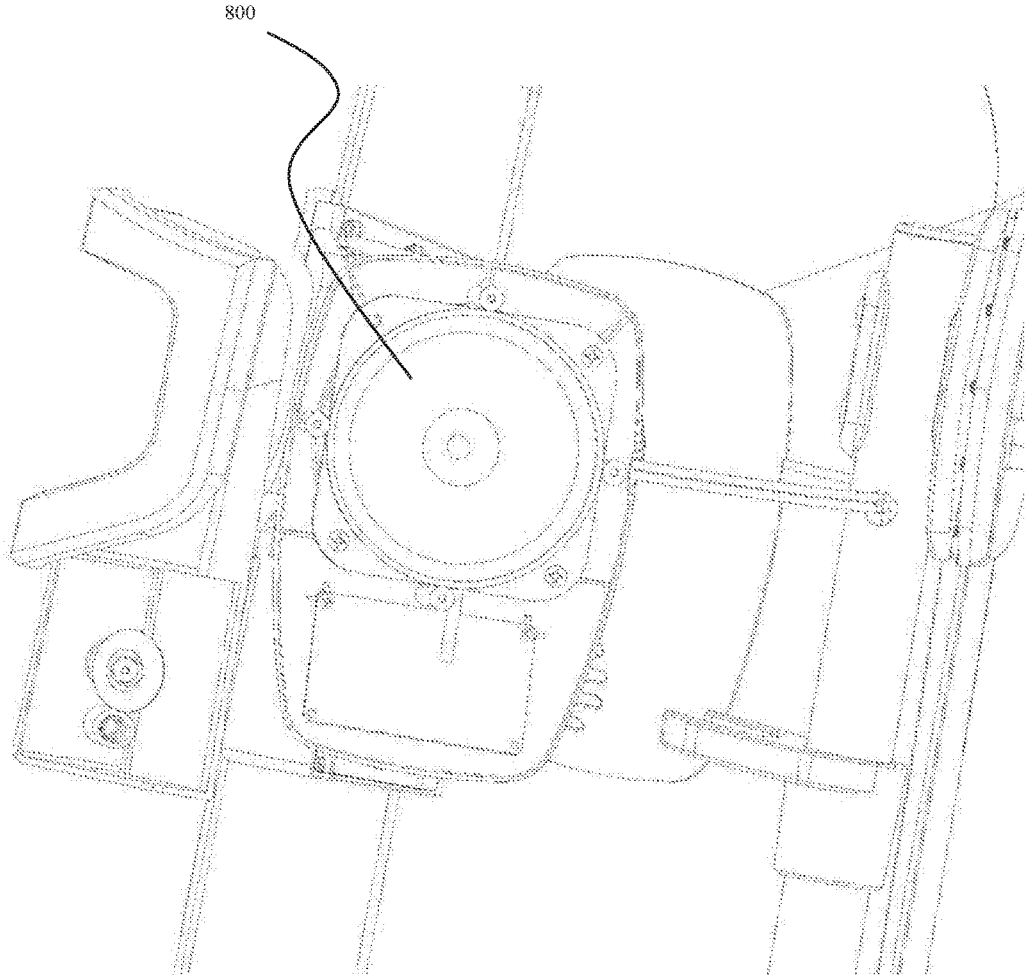
FIG. 18 shows an exemplary view of a speaker secured to the interior of an exemplary gun safe.

In one embodiment, gun safe 100 may include speakers, e.g., Bluetooth speakers. In one embodiment, the Bluetooth speakers may powered only when gun safe 100 is plugged in. Other accessories, other than Bluetooth speakers, may be added to improve the usefulness and/or functionality of gun safe 100. FIG. 18 shows an exemplary speaker 800 that may be mounted one the inside shells 110 and 120, or otherwise mounted on or secured to gun safe 100.

USB and Power Interface

In one embodiment, gun safe 100 may include one or more communication/power interfaces, e.g., a USB interface. For example, a USB port may be located on the rear of base foot 220. It should be appreciated that a USB, or other communication interface, may be integrated into gun safe 100 in many ways, and/or located in many different places on gun safe 100.

As shown in FIG. 3, base 200 may include a power charging/power interface 230, e.g., an electrical socket and/or jack. Charging/power interface 230 may be a jack that receives power from and AC source such as a conventional wall outlet, or a DC source such as an external battery. Gun safe 100 may, in one embodiment, include an AC adapter that connects toe charging/power interface 230 to provide DC power at the desired voltage and/or current to gun safe 120.

Charging/power interface 230 may be of any type known in the art. For example, charging/power interface 230 may be universal serial bus (USB) ports connectable to a wide variety of devices. Charging/power interface 230 may be used to provide electrical power to such devices and/or enable wired communication of gun safe 100 with such devices. In some embodiments, notifications, status reports, sensor data, and/or other information may be conveyed to such devices through charging/power port 230. Additionally or alternatively, such information may be conveyed wirelessly via any known protocol including but not limited to Wi-Fi, Bluetooth, Bluetooth Smart, near-field communications (NFC), cellular, radio frequency (RF), infrared (IR), and the like.

Gun Support

In one embodiment, gun safe 100 may include components and/or features for placement and/or support of a gun or other item that may be placed or stored inside gun safe 100. For example, support tube 130 may include a cut-out slot 704. Gun support 702 may be shaped as shown in FIGS. 6, 12*a* and 12*b* to fit around and slide up and down support tube 130. Screw 706 may go through a hole in gun support 702, through slot 704 in support tube 130, and may press into inner back of support tube 130 to secure gun support in place so that it does not slide up and down relative to support tube 130 and slot 704 in support tube 130. In this manner, gun support 702 may be adjusted. In one embodiment, a gun may be stored in gun safe 100 by placing the gun upright inside gun safe 100, with the base or butt of the gun resting on boot base cover 225, and the barrel of the gun resting in gun support 702, which may be adjusted based on the size or length of a gun. Guns or other items may also be stored by, e.g., securing holsters or other supports, compartments, or holders inside gun safe 100, e.g., secured to inner wall of shell 110 or to inner wall of shell 120.

MISCELLANEOUS

Although the disclosure herein highlights use of gun safe 100 for storage of guns and other firearms, the gun safe discloses herein may, without alteration, or at least without alteration outside the scope of a person of ordinary skill, be used for secure storage of items other than guns and/or firearms.

Although the description and associated drawings highlight one particular size and shape for gun safe 100, the scope of the disclosure herein extends to gun safes or secure storage compartments of different shapes and different sizes, which are within the spirit of the disclosure herein.

In general, many modifications and alterations may be made to the disclosure described herein without departing from the spirit of this disclosure.

What is claimed is:

1. A storage unit, comprising:

a first shell and a second shell, the first shell and the second shell having complementary shapes, the first shell and the second shell forming a storage space; and a gravity-assisted opening mechanism;

wherein:

one or more hinges are secured to a spine;

the first shell and the second shell are each secured to the one or more hinges along a hinged edge of the first shell and along a hinged edge of the second shell:

the first shell and the second shell rotate relative to the one or more hinges and swing on the one or more hinges relative to each other;

the spine is anchored at a bottom end of the spine to a bottom anchor point;

each of the one or more hinges are oriented such that a top of such hinge is not directly above the bottom end of such hinge; and the first shell and the second shell are disposed on top of the spine.

2. The storage unit of claim 1, further comprising a securement mechanism for securing an edge of the first shell opposite the hinged edge of the first shell ("first shell secured edge") to an edge of the second shell opposite the hinged edge of the second shell ("second shell secured edge"), and wherein:

the securement mechanism has a closed configuration in which the first shell secured edge and the second shell secured edge abut each other in a rest position; and the securement mechanism has an open configuration in which the first shell secured edge and the second shell secured edge rest apart from each other.

3. The storage unit of claim 2, wherein the securement mechanism is a lock.

4. The storage unit of claim 1, further comprising:

a motor for transitioning the lock from a locked state to an unlocked state;

an authentication module configured to:

receive credentials;

determine that the credentials are valid;

and, based on the determination that the credentials are valid, actuate the motor for transitioning the lock from a locked state to an unlocked state.

5. The storage unit of claim 4, wherein the storage unit includes a communication module configured to receive credentials by at least one of a wireless technology, Bluetooth, and biometric data.

6. The storage unit of claim 2, wherein because of an orientation of the one or more hinges, when the securement mechanism transitions from a closed configuration to an open configuration, gravity exerts a force to move the first shell secured edge away from the second shell secured edge.

7. The storage unit of claim 6, further comprising an assist mechanism to exert a force to move the first shell secured edge away from the second shell secured edge.

8. The storage unit of claim 7, wherein the assist mechanism comprises a spring.

9. The storage unit of claim 2, wherein the one or more hinges are configured to be disassembled only when the securement mechanism is in an open configuration.

10. The storage unit of claim 1, wherein at least some of the edge of the first shell and the edge of the second shell comprise a lap joint.

11. The storage unit of claim 1, further comprising a signal permeable layer.

12. The storage unit of claim 1, further comprising a communication module configured to receive and transmit data wirelessly.

13. The storage unit of claim 12, further comprising one or more speakers.

14. The storage unit of claim 1, further comprising:

at least one sensor for detecting motion data;

a processing module for processing motion data collected by that at least one sensor for detecting motion data, wherein the processing modules comprises instructions that, when executed, cause the storage unit to determine that at least motion event has occurred; and wherein a motion event comprises at least one of:

opening the storage unit;

picking up the storage unit;

shaking the storage unit;

carrying the storage unit;

rotating the storage unit;

striking the storage unit; and displacing the storage unit.

15. A storage unit, comprising:

a first shell and a second shell, the first shell and the second shell having complementary shapes, the first shell and the second shell forming a storage space;

a spine; and one or more hinges secured to the spine;

wherein:

the first shell and the second shell are each secured to the one or more hinges along a hinged edge of the first shell and along a hinged edge of the second shell;

the first shell and the second shell rotate relative to the one or more hinges and swing on the one or more hinges relative to each other;

the spine is anchored at a bottom end of the spine to a bottom anchor point;

each of the one or more hinges are oriented such that a top of such hinge is not directly above the bottom end of such hinge; and the first shell and the second shell are disposed on top of the spine;

further comprising:

a lock for securing an edge of the first shell opposite the hinged edge of the first shell ("first shell secured edge") to an edge of the second shell opposite the hinged edge of the second shell ("second shell secured edge"), wherein:

the lock has a closed configuration in which the first shell secured edge and the second shell secured edge abut each other in a rest position; and the lock has an open configuration in which the first shell secured edge and the second shell secured edge rest apart from each other.

16. The storage unit of claim 15, wherein the spine is anchored at the bottom end of the spine to a base.

17. The storage unit of claim 15, wherein the one or more hinges are configured to be disassembled only when the securement mechanism is in an open configuration.

18. The storage unit of claim 15, further comprising a spring assist mechanism to exert a force to move the first shell secured edge away from the second shell secured edge.

* * * * *